US008702466B2

(12) United States Patent
Cheng et al.

(10) Patent No.: US 8,702,466 B2
(45) Date of Patent: Apr. 22, 2014

(54) MODEL HELICOPTER

(75) Inventors: Bob Cheng, Shenzhen (CN); Darren Matloff, Fairview Heights, IL (US)

(73) Assignee: Asian Express Holdings Limited, Hong Kong (HK)

( * ) Notice: Subject to any disclaimer, the term of this patent is extended or adjusted under 35 U.S.C. 154(b) by 532 days.

(21) Appl. No.: 12/497,480

(22) Filed: Jul. 2, 2009

(65) Prior Publication Data

US 2010/0003886 A1 Jan. 7, 2010

Related U.S. Application Data

(60) Provisional application No. 61/077,573, filed on Jul. 2, 2008.

(51) Int. Cl.
*A63H 27/127* (2006.01)
*B64C 27/08* (2006.01)

(52) U.S. Cl.
USPC ..... 446/36; 244/17.23

(58) Field of Classification Search
USPC ..... 446/34, 36–40; 244/17.11, 17.13, 244/17.19, 17.21, 17.23, 17.25; 416/120, 416/125, 128
See application file for complete search history.

(56) References Cited

U.S. PATENT DOCUMENTS

| | | | | |
|---|---|---|---|---|
| 1,800,471 A | | 4/1931 | Oehmichen | |
| 2,312,624 A | * | 3/1943 | Caldwell | 416/125 |
| 2,384,516 A | | 9/1945 | Young | |
| 2,414,435 A | * | 1/1947 | Bendix | 416/24 |
| 2,646,848 A | | 7/1953 | Young | |
| 2,997,110 A | | 8/1961 | Adler | |
| 3,029,048 A | | 4/1962 | Brooks | |
| 3,053,480 A | | 9/1962 | Vanderlip | |
| 3,093,929 A | | 6/1963 | Robbins et al. | |
| 3,119,611 A | * | 1/1964 | Bennett | 472/9 |

(Continued)

FOREIGN PATENT DOCUMENTS

| | | |
|---|---|---|
| BE | 1016960 A3 | 11/2007 |
| CN | 1496923 A | 5/2004 |

(Continued)

OTHER PUBLICATIONS

Aug. 25, 2009 International Search Report, Application No. PCT/US2009/049635.

(Continued)

*Primary Examiner* — Gene Kim
*Assistant Examiner* — Alyssa Hylinski
(74) *Attorney, Agent, or Firm* — Knobbe Martens Olson & Bear, LLP

(57) ABSTRACT

A toy helicopter with four electric motors having a main body, at least one battery, and front and rear coaxial rotor assemblies. The front coaxial rotor assembly is made up of front upper and lower rotors and a front stabilizing bar operatively connected to the front upper rotor. The rear coaxial rotor assembly is made up of rear lower and upper rotors and a rear stabilizing bar operatively connected to the rear upper rotor. The helicopter includes a means for concentrically rotating the front lower and upper rotors in opposite directions and a means for concentrically rotating the rear lower and upper rotors in opposite directions. The means for concentrically rotating the front lower and upper rotors in opposite directions includes first and second front electric motors, and the means for concentrically rotating the rear lower and upper rotors in opposite directions includes first and second rear electric motors.

23 Claims, 26 Drawing Sheets

(56) References Cited

U.S. PATENT DOCUMENTS

| | | | | |
|---|---|---|---|---|
| 3,141,668 | A * | 7/1964 | Nicholson | 472/9 |
| 3,231,222 | A | 1/1966 | Scheutzow | |
| 3,905,565 | A | 9/1975 | Kolwey | |
| 4,008,979 | A | 2/1977 | Cooper et al. | |
| 4,084,345 | A | 4/1978 | Tanaka | |
| 4,654,659 | A * | 3/1987 | Kubo | 340/13.29 |
| 4,676,459 | A * | 6/1987 | Seefluth | 244/65 |
| 5,071,383 | A * | 12/1991 | Kinoshita | 446/37 |
| 5,259,729 | A | 11/1993 | Fujihira | |
| 5,609,312 | A | 3/1997 | Arlton et al. | |
| 5,628,620 | A | 5/1997 | Arlton | |
| 5,749,540 | A | 5/1998 | Arlton | |
| 5,791,592 | A | 8/1998 | Nolan et al. | |
| 5,836,545 | A | 11/1998 | Arlton et al. | |
| 5,879,131 | A | 3/1999 | Arlton et al. | |
| 5,906,476 | A | 5/1999 | Arlton | |
| 5,971,320 | A * | 10/1999 | Jermyn et al. | 244/17.25 |
| 6,045,469 | A * | 4/2000 | Gleason et al. | 473/613 |
| 6,086,016 | A | 7/2000 | Meek | |
| 6,089,501 | A | 7/2000 | Frost | |
| 6,179,247 | B1 * | 1/2001 | Milde, Jr. | 244/23 A |
| 6,659,395 | B2 | 12/2003 | Rehkemper | |
| 6,732,973 | B1 | 5/2004 | Rehkemper | |
| 6,758,436 | B2 | 7/2004 | Rehkemper et al. | |
| 6,899,586 | B2 | 5/2005 | Davis | |
| 6,929,215 | B2 | 8/2005 | Arlton | |
| 6,960,112 | B2 | 11/2005 | Helmlinger | |
| 7,100,866 | B2 | 9/2006 | Rehkemper et al. | |
| 7,178,758 | B2 | 2/2007 | Rehkemper | |
| 7,273,195 | B1 * | 9/2007 | Golliher | 244/17.11 |
| D568,947 | S | 5/2008 | Van De Rostyne et al. | |
| D576,215 | S | 9/2008 | Van De Rostyne et al. | |
| 7,422,505 | B2 | 9/2008 | Van de Rostyne | |
| 7,425,167 | B2 | 9/2008 | Van de Rostyne | |
| 7,425,168 | B2 | 9/2008 | Van de Rostyne | |
| D579,403 | S | 10/2008 | Van de Rostyne et al. | |
| D580,344 | S | 11/2008 | Wai | |
| 7,494,397 | B2 | 2/2009 | Van de Rostyne | |
| 7,712,701 | B1 * | 5/2010 | Ehrmantraut et al. | 244/23 C |
| 7,789,341 | B2 * | 9/2010 | Arlton et al. | 244/17.23 |
| 2002/0049518 | A1 * | 4/2002 | Yamamoto | 701/2 |
| 2004/0007644 | A1 | 1/2004 | Phelps, III et al. | |
| 2004/0092207 | A1 * | 5/2004 | Hansen | 446/454 |
| 2004/0129833 | A1 * | 7/2004 | Perlo et al. | 244/70 |
| 2005/0121553 | A1 * | 6/2005 | Isawa et al. | 244/17.19 |
| 2006/0009118 | A1 * | 1/2006 | Fosbenner et al. | 446/438 |
| 2006/0121819 | A1 | 6/2006 | Isawa | |
| 2006/0231677 | A1 * | 10/2006 | Zimet et al. | 244/17.23 |
| 2007/0012818 | A1 | 1/2007 | Miyazawa | |
| 2007/0105474 | A1 * | 5/2007 | Gotou et al. | 446/37 |
| 2007/0105475 | A1 * | 5/2007 | Gotou et al. | 446/37 |
| 2007/0164148 | A1 | 7/2007 | Van De Rostyne | |
| 2007/0164149 | A1 | 7/2007 | Van de Rostyne | |
| 2007/0164150 | A1 | 7/2007 | Van de Rostyne et al. | |
| 2007/0181742 | A1 | 8/2007 | Van de Rostyne et al. | |
| 2007/0215750 | A1 * | 9/2007 | Shantz et al. | 244/17.23 |
| 2007/0262197 | A1 | 11/2007 | Phelps, III et al. | |
| 2007/0272794 | A1 | 11/2007 | Van de Rostyne | |
| 2008/0085653 | A1 | 4/2008 | Van De Rostyne | |
| 2008/0299867 | A1 | 12/2008 | Van de Rostyne et al. | |
| 2009/0047861 | A1 | 2/2009 | Van de Rostyne et al. | |
| 2009/0047862 | A1 | 2/2009 | Van de Rostyne et al. | |
| 2009/0104836 | A1 | 4/2009 | Van de Rostyne et al. | |
| 2009/0117812 | A1 * | 5/2009 | Van de Rostyne et al. | 446/37 |
| 2010/0108801 | A1 * | 5/2010 | Olm et al. | 244/17.23 |

FOREIGN PATENT DOCUMENTS

| | | | | |
|---|---|---|---|---|
| CN | 200998600 | Y | * | 1/2008 |
| CN | 2007020118076 | | | 1/2008 |
| JP | 2004121798 | A2 | | 4/2004 |
| JP | 2005193905 | A2 | | 7/2005 |
| JP | 02005225347 | | | 8/2005 |
| TW | 0320425 | Y | | 10/2007 |
| WO | WO 03/080433 | A1 | | 10/2003 |
| WO | WO 2008/085192 | A2 | | 7/2008 |

OTHER PUBLICATIONS

Ashby, David, Twister Skylift—Product Review, RCM&E Magazine, Feb. 2008.

* cited by examiner

| TABLE 1 | |
|---|---|
| 100 | model helicopter capable of flight |
| 120 | main body |
| 124<br>126 | opposite sides of main body 120 |
| 128 | top side of main body 120 |
| 130 | bottom side of main body 120 |
| 140 | front end of main body 120 |
| 140t | front topside 140t of main body 120 |
| 150 | LED (light emitting diode) 150 |
| 160 | rear end of main body 120 |
| 160t | rear topside of main body 120 |
| 180 | front coaxial rotor assembly |
| 200 | rear coaxial rotor assembly |
| 220 | front coaxial rotor shaft |
| 221 | longitudinal axis of shaft 220 |
| 225 | outer shaft of front coaxial rotor shaft 220 |
| 225r | outer shaft of rear coaxial rotor shaft 240 |
| 226 | top end of outer shaft 225 |
| 226r | top end of outer shaft 225r |
| 230 | inner shaft of front coaxial rotor shaft 220 |
| 230r | inner shaft of rear coaxial rotor shaft 240 |

*Fig. 23*

| TABLE 1 (CONTINUED) | |
|---|---|
| 232 | top end of inner shaft 230 |
| 232r | top end of inner shaft 230r |
| 240 | rear coaxial rotor shaft 240 |
| 241 | longitudinal axis of shaft 240 |
| 242 | front rotor shaft extension member |
| 242r | rear rotor shaft extension member |
| 243 | cross-arm of front rotor shaft extension member 242 |
| 243r | cross-arm of rear rotor shaft extension member 242r |
| 244 | upper ball shaped end of rotor shaft extension member 242 |
| 244r | upper ball shaped end of rotor shaft extension member 242r |
| 246 | lower end of rotor shaft extension member 242 |
| 246r | lower end of rotor shaft extension member 242r |
| 248 | concave socket located midway along the front upper rotor 280 |
| 248r | concave socket located midway along the rear upper rotor 340 |
| 250 | fixing plate for securing ball shaped end 244 to the interior of concave socket 248 |
| 250r | fixing plate for securing ball shaped end 244r to interior of concave socket 248r. |
| 252 | plurality of fasteners used to affix the fixing plate 250 to the underside of the middle portion 285 of the front upper rotor 280 |
| 252r | plurality of fasteners used to affix the fixing plate 250r to the underside of the middle portion 285r of the rear upper rotor 340 |
| 254a<br>254b | first and second front stabilizing bar arms 254a and 254b |

*Fig. 24*

| TABLE 1 (CONTINUED) | |
|---|---|
| 254ar<br>254br | first and second rear stabilizing bar arms 254ar and 254br |
| 256ar<br>256br | first and second rear stabilizing joints 256ar and 256br |
| 258a<br>258b | front upper rotor spurs 258a and 258b |
| 258ar<br>258br | rear upper rotor spurs 258ar and 258br |
| 259a<br>259b | front stabilizing spur joints 259a and 259b |
| 259ar<br>259br | rear stabilizing spur joints 259ar and 259br |
| 260 | front lower rotor |
| 280 | front upper rotor |
| 285 | middle portion of the front upper rotor 280 |
| 285r | middle portion of the rear upper rotor 340 |
| 300 | front stabilizing bar |
| 300r | rear stabilizing bar |
| 305 | first front longitudinal axis 305 of front stabilizing bar 300 |
| 305r | first rear longitudinal axis 305r of rear stabilizing bar 300r |
| 307 | middle portion of front stabilizing bar 300 |
| 307r | middle portion of rear stabilizing bar 300r |
| 309 | open rectangular section of middle portion 307 |
| 309r | open rectangular section of middle portion 307r |

*Fig. 25*

| TABLE 1 (CONTINUED) | |
|---|---|
| 310a<br>310b | weighted opposite ends of front stabilizing bar 300 |
| 310ar<br>310br | weighted opposite ends of rear stabilizing bar 300r |
| 312a<br>312b | first and second opposite facing circular through bores located in open rectangular section 309 |
| 312ar<br>312br | first and second opposite facing circular through bores located in open rectangular section 309r |
| 315a<br>315b | first and second front links 315a and 315b which connect front upper rotor 280 to front stabilizing bar 300 and *vice versa* |
| 315ar<br>315br | first and second rear links 315ar and 315br which connect rear upper rotor 340 to rear stabilizing bar 300r and *vice versa* |
| 320 | rear lower rotor |
| 340 | rear upper rotor |
| 380 | rotor blades of lower front rotor 260 |
| 400 | rotor blades 400 (typically, but not exclusively, blades 400a and 400b) of upper front rotor 280 |
| 410a<br>410b | free ends of blades 400a and 400b, respectively |
| 415 | a second front longitudinal axis 415 defined by blades 400a and 400b |
| 420 | rotor blades ( of lower rear rotor 320 |
| 440 | rotor blades 440 (typically, but not exclusively, blades 440a and 440b) of upper rear rotor 340 |
| 450a<br>450b | free ends of blades 440a and 440b, respectively |

*Fig. 26*

| TABLE 1 (CONTINUED) | |
|---|---|
| 455 | longitudinal axis 455 which passes through opposite ends 440a and 440b of rear upper rotor 340 |
| 460 | front drive gear assembly |
| 460r | rear drive gear assembly |
| 480 | first front gear |
| 480r | first rear gear |
| 500 | second front gear |
| 500r | second rear gear |
| 520 | first front electric motor |
| 520r | first rear electric motor |
| 540 | first front pinion gear |
| 540r | first rear pinion gear |
| 560 | second front electric motor |
| 560r | second rear electric motor |
| 580 | second front pinion gear |
| 580r | second rear pinion gear |
| 590 | front subassembly |
| 590r | rear subassembly |
| 600 | front landing support |
| 620 | rear wheels |
| 640 | at least one battery |

*Fig. 27*

| TABLE 1 (CONTINUED) | |
|---|---|
| 660 | recharge socket |
| 670 | on/off switch |
| 675 | first printed circuit board |
| 677 | optional second circuit board 677 that serves as a junction box |
| 679 | an onboard controller |
| 680 | lower bar |
| 685 | remote wireless controller |
| 687 | onboard receiver |
| 700 | upper bar |
| 800<br>820 | first and second front motor housing units 800 and 820 |
| 800r<br>820r | first and second rear motor housing units 800 and 820 |
| 840 | front shaft-housing |
| 840r | rear shaft-housing |

*Fig. 28*

MODEL HELICOPTER

CROSS-REFERENCE TO RELATED APPLICATIONS

This application claims priority of provisional patent application No. 61/077,573 to Bob Cheng, filed on Jul. 2, 2008, entitled MODEL HELICOPTER. Application No. 61/077,573, the entirety of which is herein incorporated by reference in its entirety.

BACKGROUND OF THE INVENTION

1. Field of the Invention

This invention relates generally to wirelessly controlled helicopters. More specifically, the invention relates to a model helicopter that employs two pairs of counter rotating main blades in tandem configuration.

2. Background of the Invention

Children and adults are often thrilled by model or toy size flying objects and in particular remote or wirelessly operated toy helicopters. Toy helicopters capable of flight offer great fun for children and adults.

SUMMARY OF THE INVENTION

One aspect of the present invention comprises a toy helicopter with four electric motors and capable of flight, having a main body, at least one battery, and front and rear coaxial rotor assemblies. The front coaxial rotor assembly is made up of front upper and lower rotors and a front stabilizing bar operatively connected to the front upper rotor. The rear coaxial rotor assembly is made up of rear lower and upper rotors and a rear stabilizing bar operatively connected to the rear upper rotor. The helicopter includes a means for concentrically rotating the front lower and upper rotors in opposite directions and a means for concentrically rotating the rear lower and upper rotors in opposite directions. The means for concentrically rotating the front lower and upper rotors in opposite directions includes first and second front electric motors, and the means for concentrically rotating the rear lower and upper rotors in opposite directions includes first and second rear electric motors.

BRIEF DESCRIPTION OF THE DRAWINGS

FIGS. 23 through 28 show a table listing part numbers.

DETAILED DESCRIPTION OF THE PREFERRED EMBODIMENTS

The embodiments described below are directed to a model helicopter with two rotor assemblies in tandem configuration. The terms "model helicopter" and "toy helicopter" are hereinafter regarded as equivalent terms. The terms "stabilizing bar", "fly bar" and "flybar" are hereinafter regarded as equivalent terms.

Figure 1:
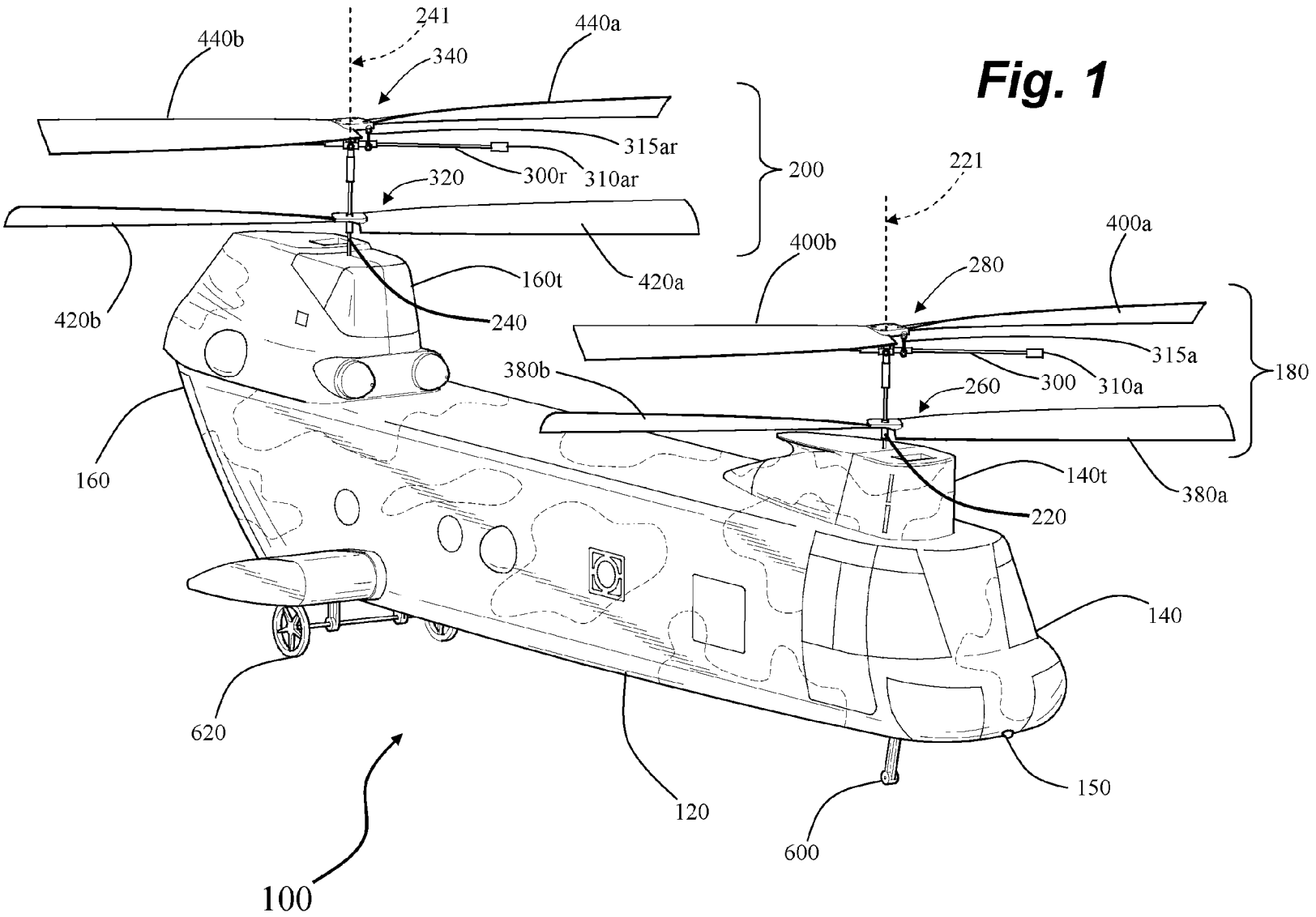
FIG. 1 is a perspective view of a model helicopter, according to one embodiment.
Figure 2:
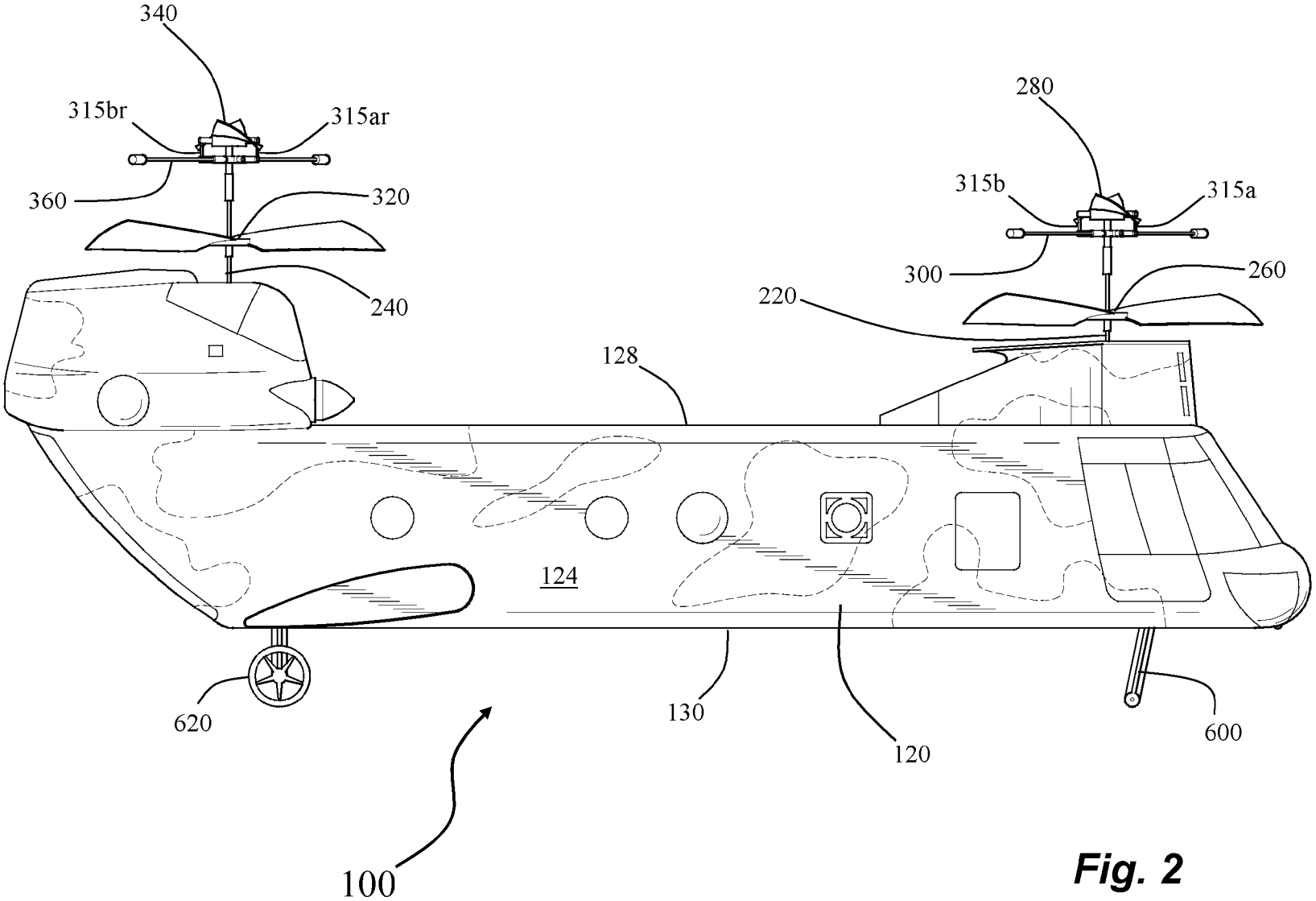
FIG. 2 is a lengthwise side view of the model helicopter of FIG. 1.
Figure 3:
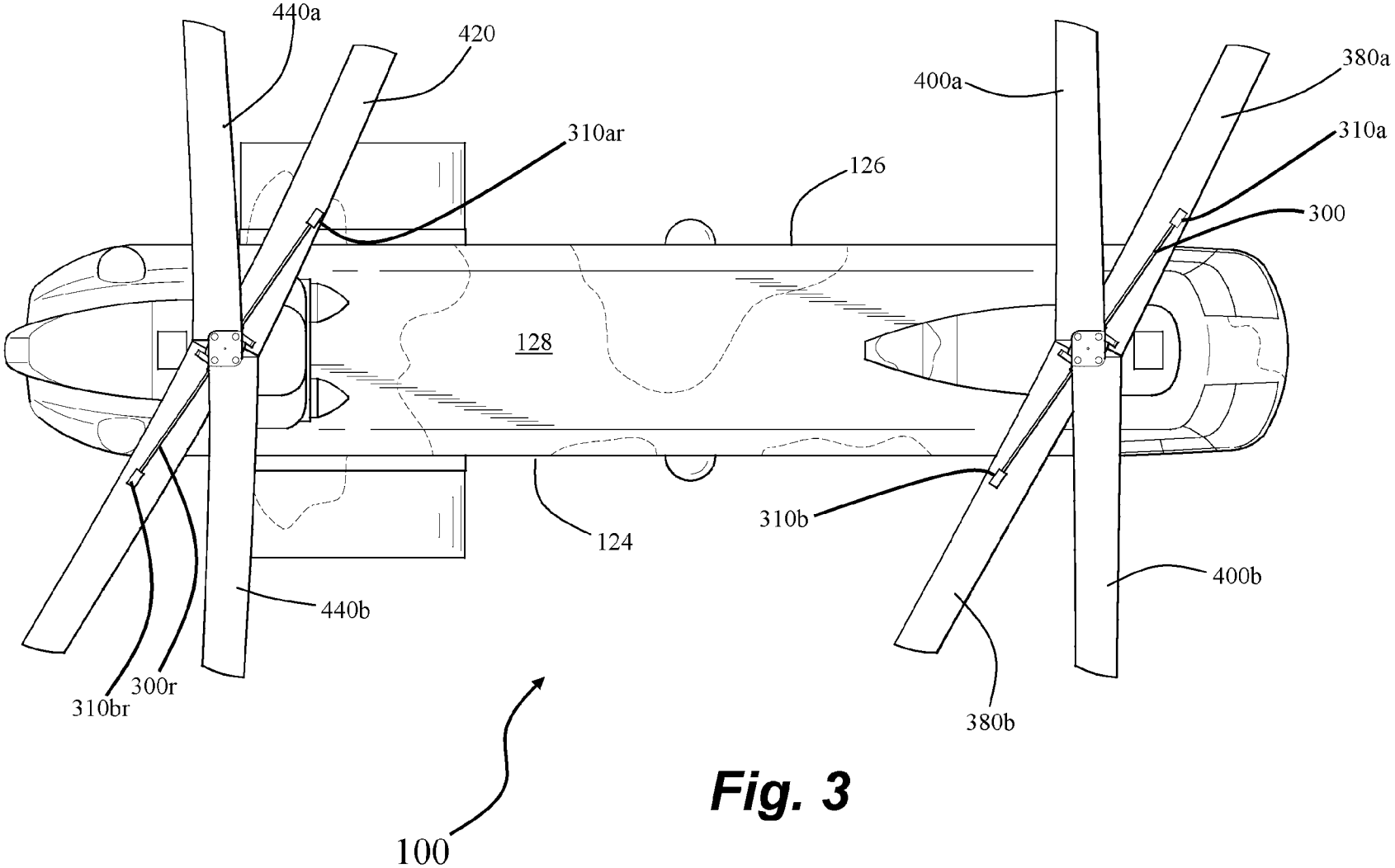
FIG. 3 is a lengthwise top view of the model helicopter of FIG. 1.
Figure 4:
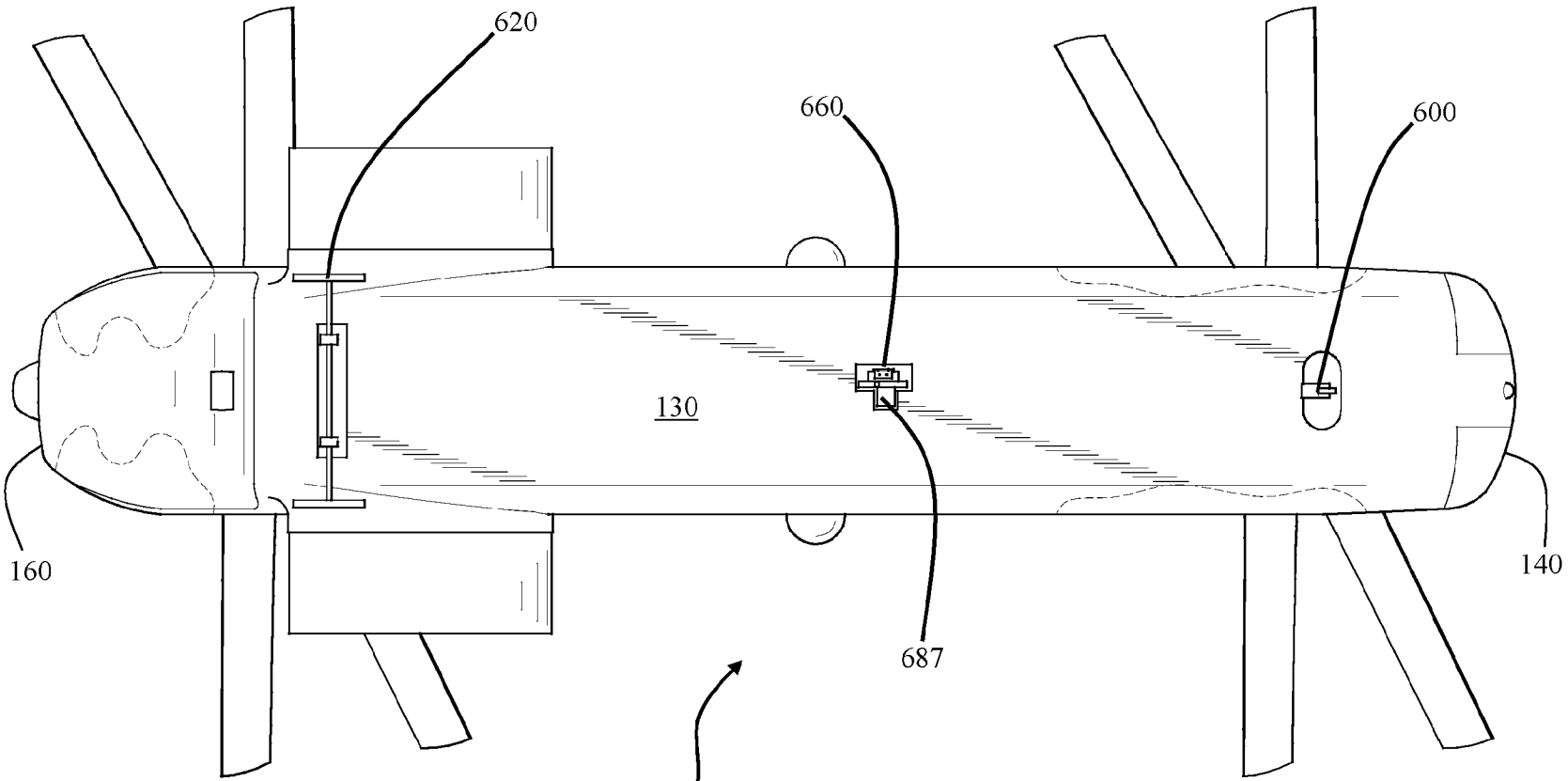
FIG. 4 is a lengthwise bottom view of the model helicopter of FIG. 1.
Figure 5:
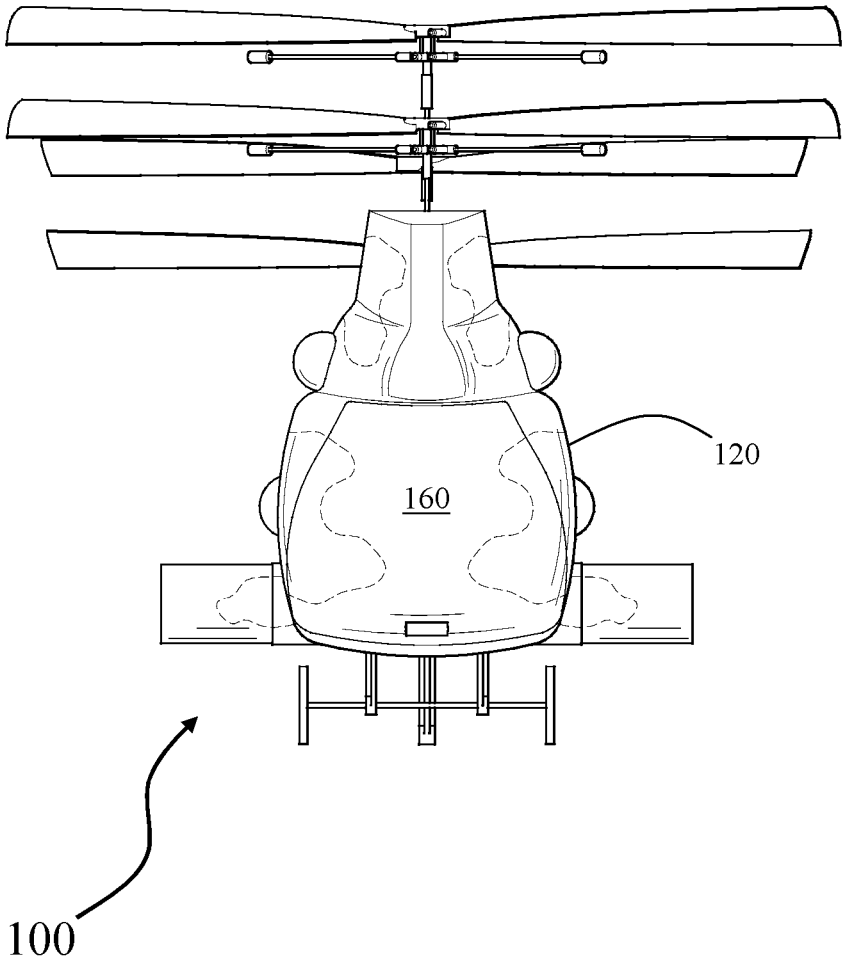
FIG. 5 is a rear end view of the model helicopter of FIG. 1.
Figure 6:
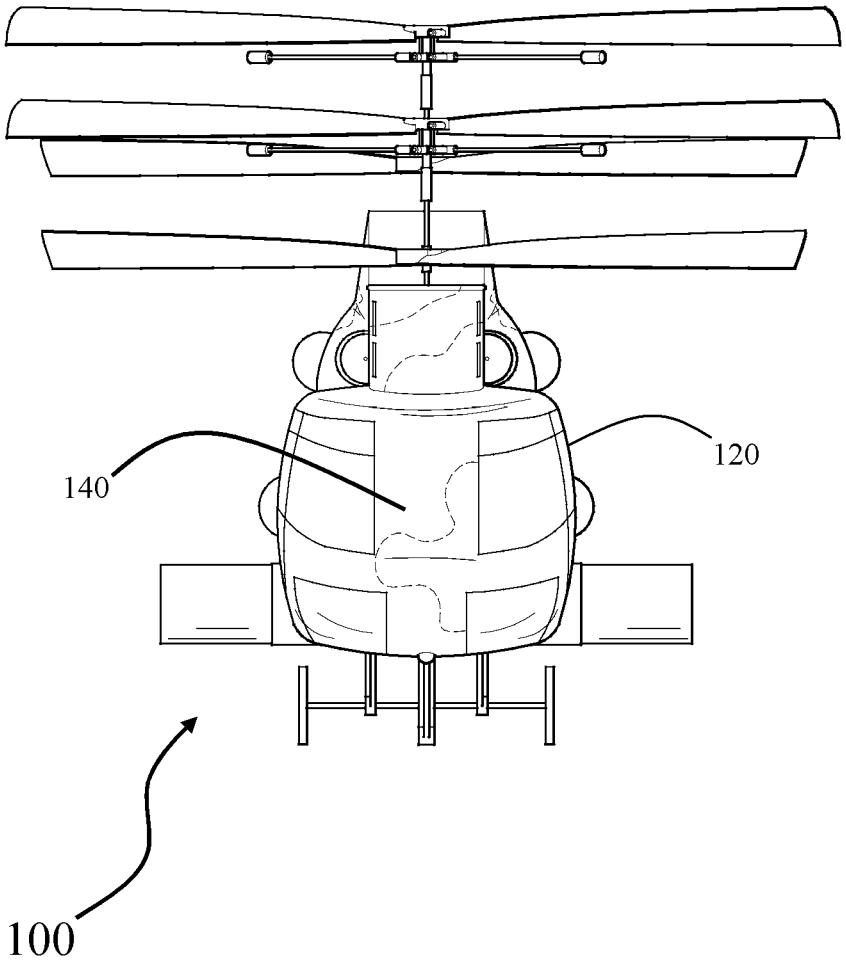
FIG. 6 is a front end view of the model helicopter of FIG. 1.
Figure 7:
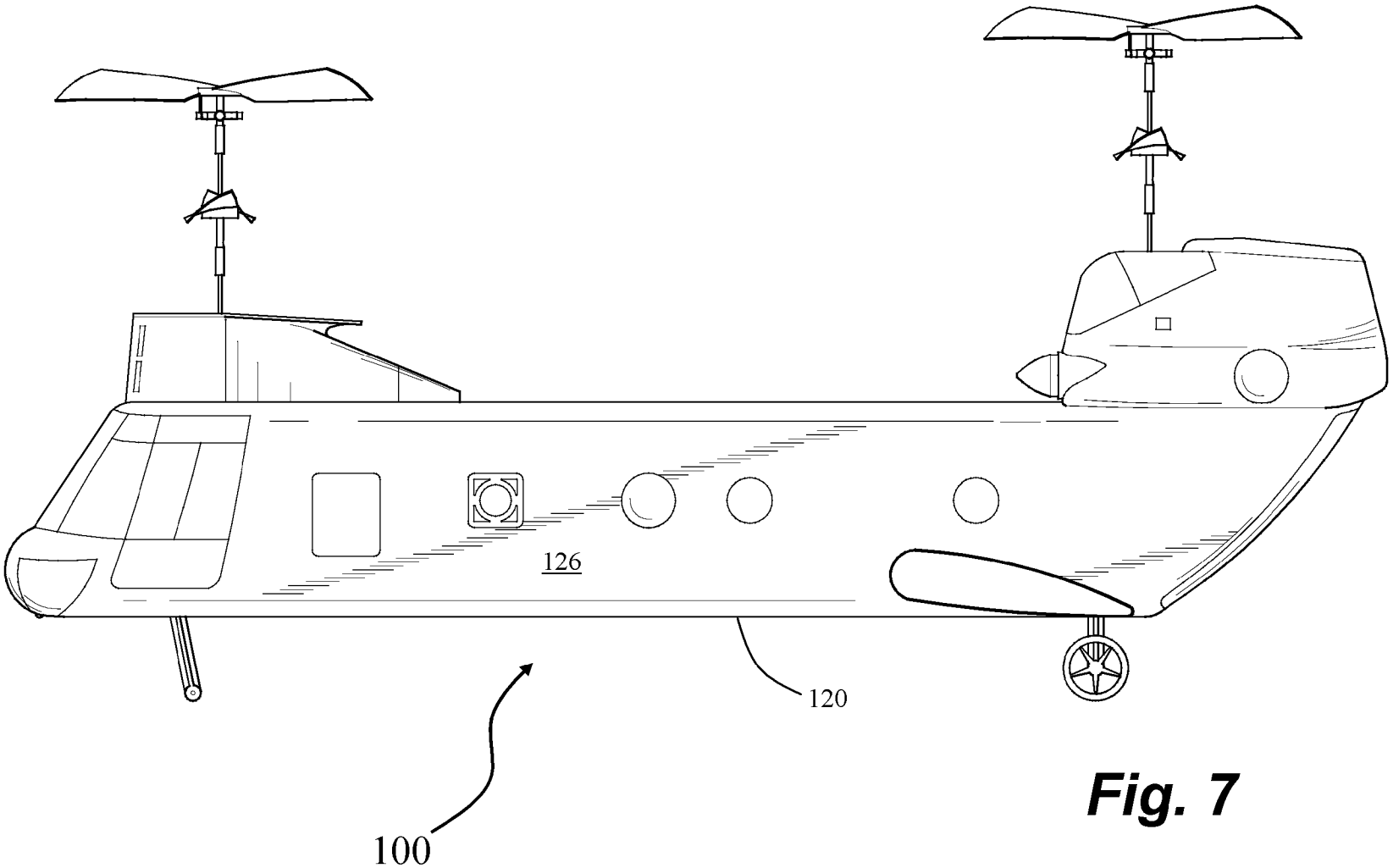
FIG. 7 is a lengthwise side view of the model helicopter of FIG. 1.

It will be understood that the terms "upper and lower", "front and rear", and "top and bottom" are used for convenience to describe relative directional reference in the common orientation of model helicopter 100 as shown, for example, in FIG. 1.

The model helicopter of the embodiment described below is denoted generally by the numeric label "100".

FIG. 1 shows a model helicopter 100 according to one embodiment. In the illustrated embodiments, the model helicopter 100 comprises a main body 120 having a front end 140 defining a front topside **140*t*, a rear end 160 defining a rear topside 160*t*, a front coaxial rotor assembly 180, a rear coaxial rotor assembly 200, a front coaxial rotor shaft 220, and a rear coaxial rotor shaft 240. The main body 120 can be made out of any suitable material such as, but not limited to, foamed plastic such as expanded polystyrene foam (EPS) of sufficient structural rigidity to house components, such as a battery, motors and gearing system. The main body 120 further defines opposite sides 124 and 126, top side 128, and bottom side 130. An optional front light is disposed at the front 140 of the model helicopter 100; the front light can be any suitable light such as an LED (light emitting diode) 150**.

In one embodiment, the main body 120 is made entirely of expanded polystyrene foam (EPS, Styrofoam). In another embodiment, the main body is made entirely of plastic, such as polyethylene terephthalate (PET). In another embodiment, the main body comprises an inner portion made of a foamed plastic, such as EPS, and an outer plastic shell made of plastic, such as PET. Instead of PET, a similar plastic material can be used, such as polyvinyl chloride (PVC) or polycarbonate (PC). Different thicknesses can be used, resulting in different weight and other mechanical properties. In one embodiment, the plastic shell thickness is 0.17 to 0.18 mm. The plastic outer shell can be attached to the EPS inner portion by glue, weld, adhesive, or mechanical (or friction) fit. The plastic outer shell can also merely encase the inner portion without any attachment means. The plastic outer shell will stay in place because it matches the outer surface of the inner foamed plastic portion and acts as a shell. The plastic shell is an economical way to improve the aesthetics of the main body. Logos, colors, patterns, and other aesthetic elements can be printed, embossed, or otherwise processed onto the plastic shell. The prior art required the use of decals or paint in order to make the foamed plastic main body aesthetically pleasing. The plastic shell can be a single piece outside shell, molded or formed to enclose the foamed plastic inner portion. In the case where the main body is made entirely of plastic, the plastic main body can be a single piece. The plastic shell or plastic main body can also comprise two or more separate plastic parts, where they are combined together to form the whole of the main body 120 (with the foamed plastic inner portion in the case of a plastic shell). In one embodiment, the plastic shell comprises two separate pieces, each constituting half of the main body plastic shell. These two plastic shell pieces are then coupled together (using glue, weld, adhesive, or mechanical fit), encasing the foamed plastic inner portion, or they can be directly coupled to the foamed plastic inner portion. This two piece plastic shell embodiment also allows for easy assembly of the main body. The plastic shell increases the durability of the model helicopter, by protecting the foamed plastic inner portion from damage and from weather elements, and by improving the rigidity of the model helicopter to withstand crashes. The plastic shell also acts as a sound barrier and dampens sound. In one embodiment, the plastic shell causes an 80% noise reduction.

The front coaxial rotor assembly 180 comprises a front lower rotor 260, a front upper rotor 280, and a front stabilizing bar 300 operatively connected to the front upper rotor 280. The front stabilizing bar 300 has weighted opposite ends 310*a* and 310*b*.

The front stabilizing bar 300 stabilizes the front upper rotor 280. During operation of the model helicopter 100 the front lower rotor 260 and front upper rotor 280 are rotated concentrically in opposite directions with respect to each other while the front stabilizing bar 300 is concentrically rotated in the same direction as the front upper rotor 280.

Front lower and upper rotors 260 and 280 are counter rotated by front coaxial rotor shaft 220. The front coaxial rotor shaft 220 is mounted inside body front shaft-housing 840 and driven by a front drive gear assembly 460. The front drive gear assembly 460 includes first and second front gears 480 and 500, respectively. A front first electric motor 520 drives a front first pinion gear 540 that drives the first front gear 480, while a front second electric motor 560 drives a front second pinion gear 580 that drives the second front gear 500.

Figure 8:
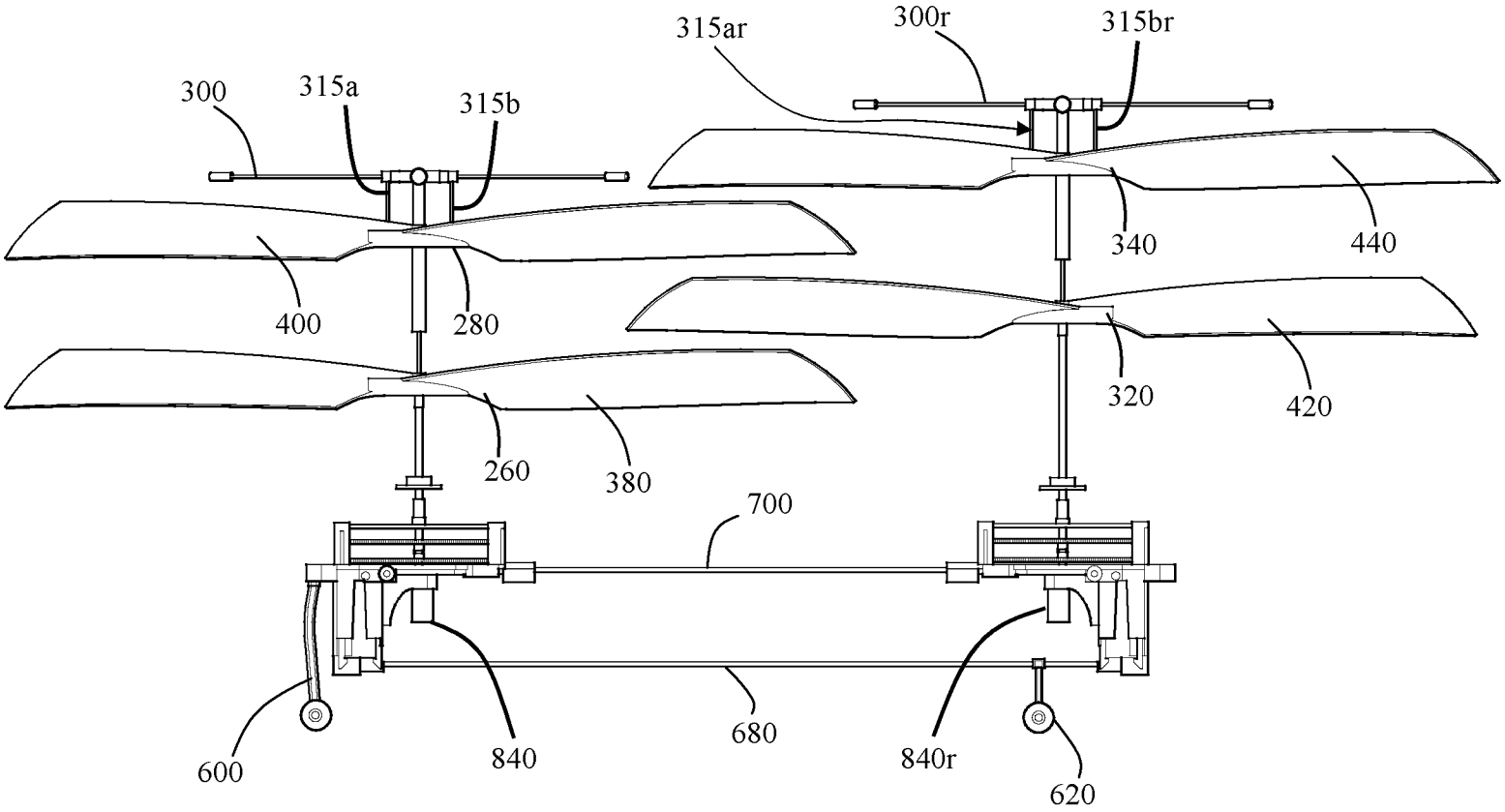
FIG. 8 is a view of the model helicopter showing upper and lower bars.
Figure 9:
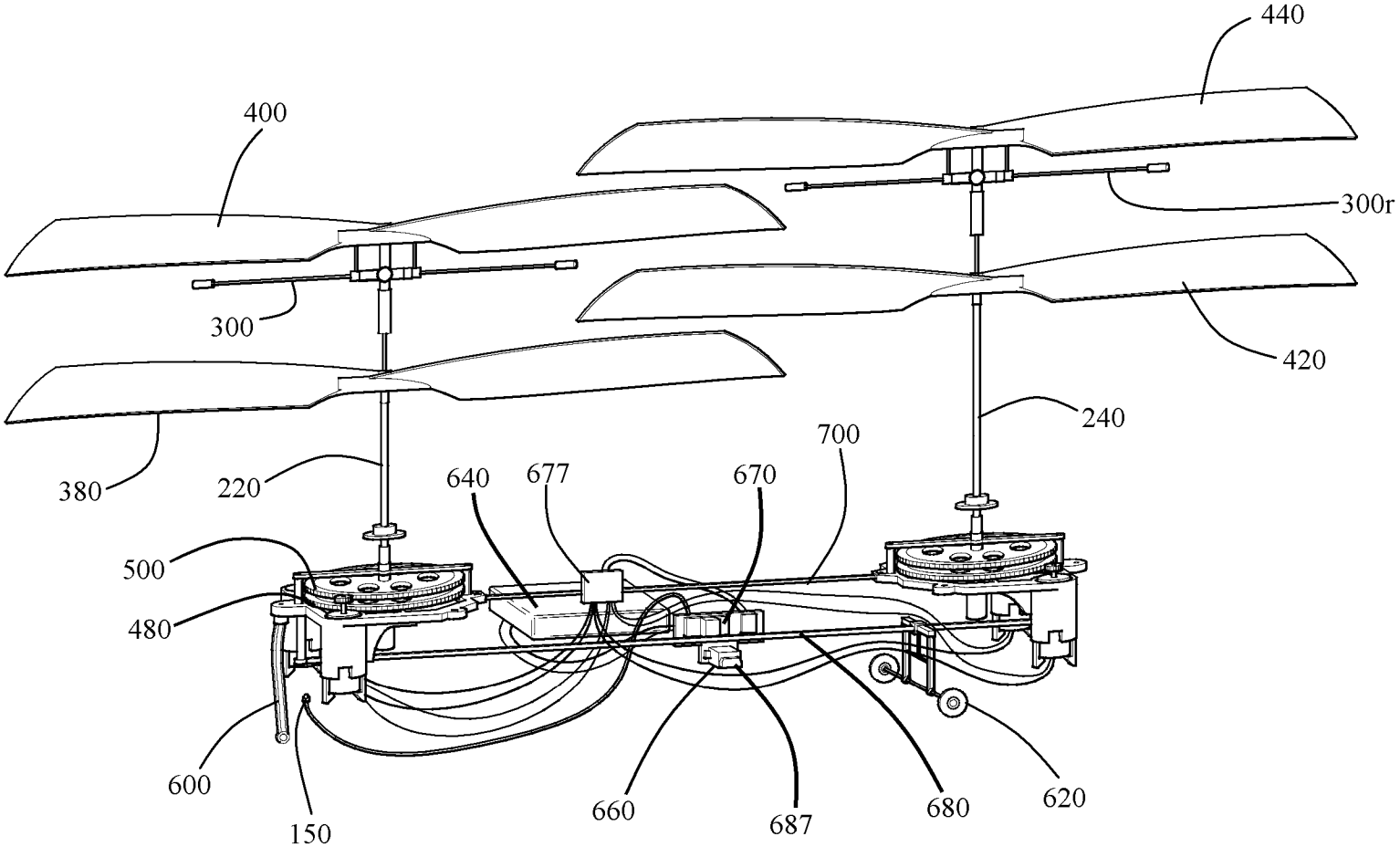
FIG. 9 is a view of the model helicopter showing some internal components with main body not shown.
Figure 10:
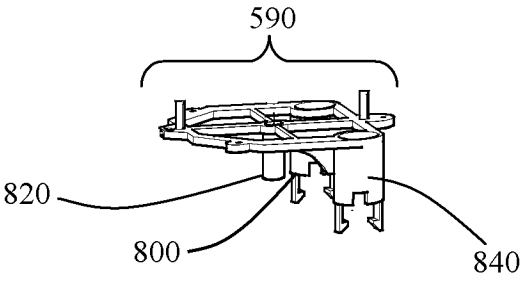
FIG. 10 shows a front subassembly.
Figure 11:
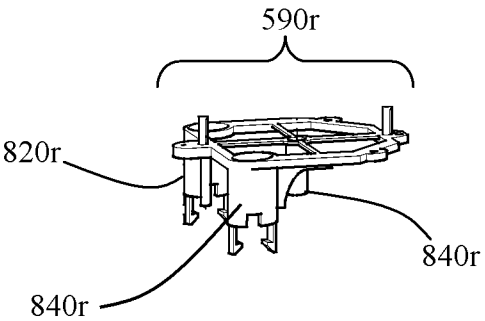
FIG. 11 shows a rear subassembly.
Figure 13:
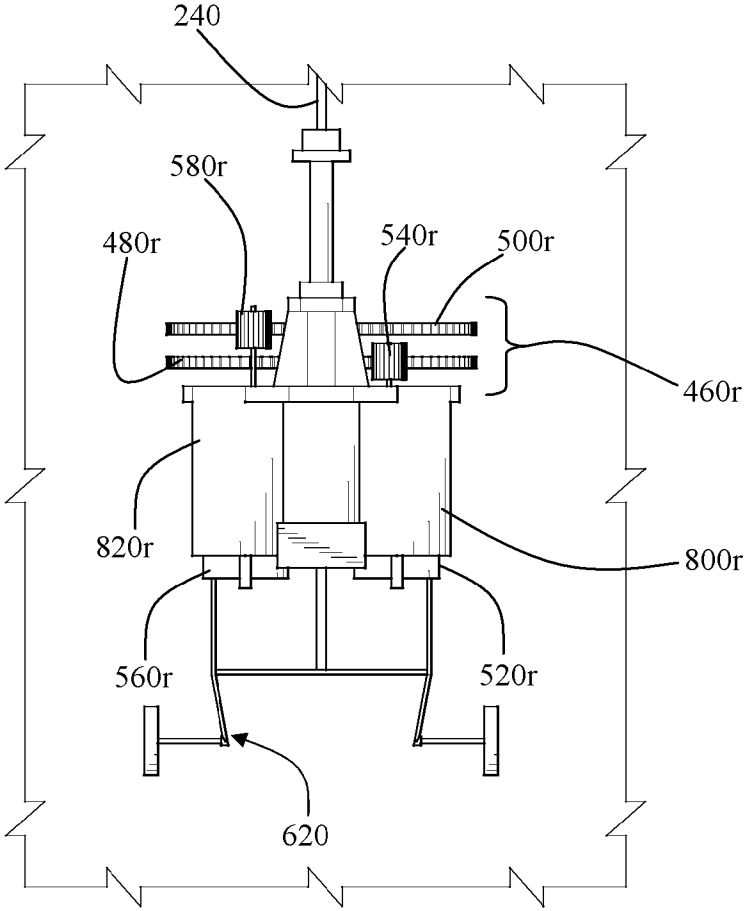
FIGS. 12 and 13 respectively show details of the front and rear ends of the helicopter of FIG. 1 with main body not shown.
Figure 12:
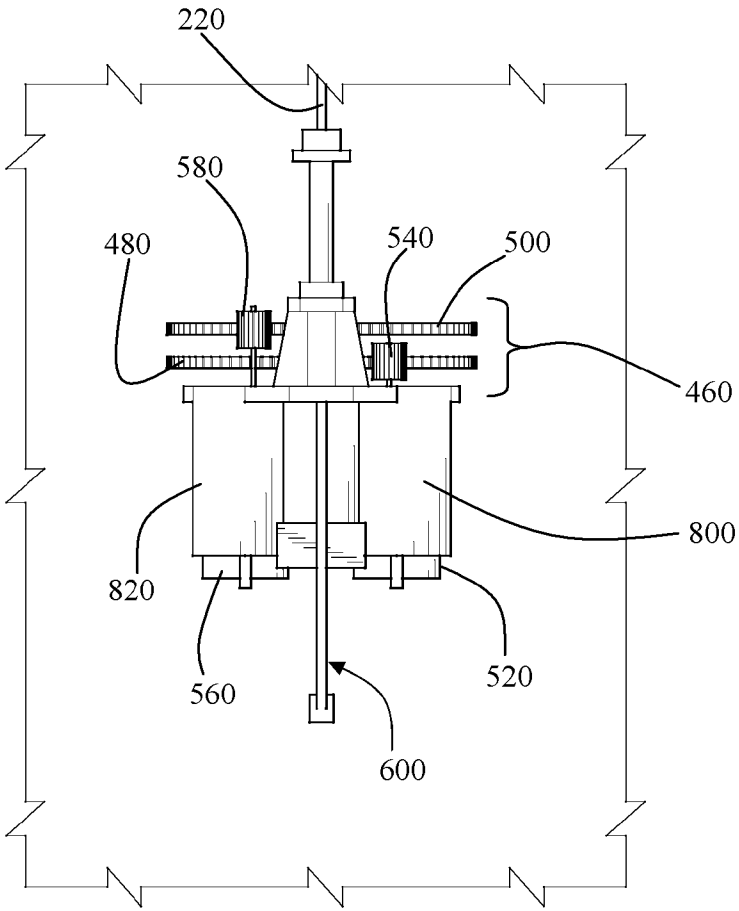
Figure 15:
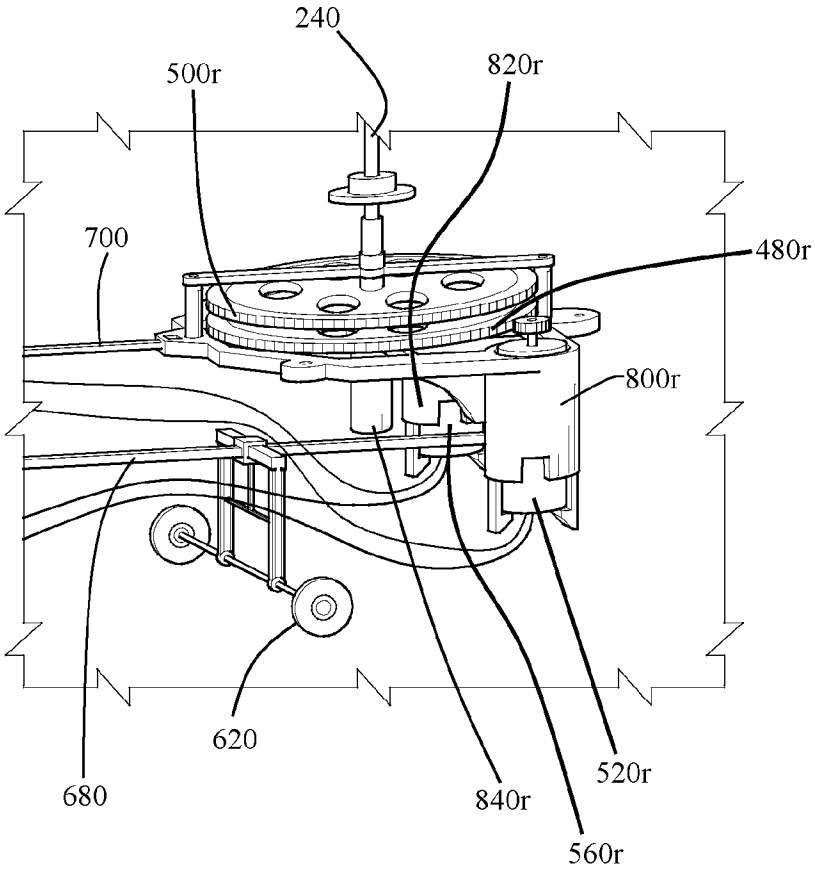
FIGS. 14 and 15 respectively show side views of the front and rear of the helicopter of FIG. 1 with main body not shown.
Figure 14:
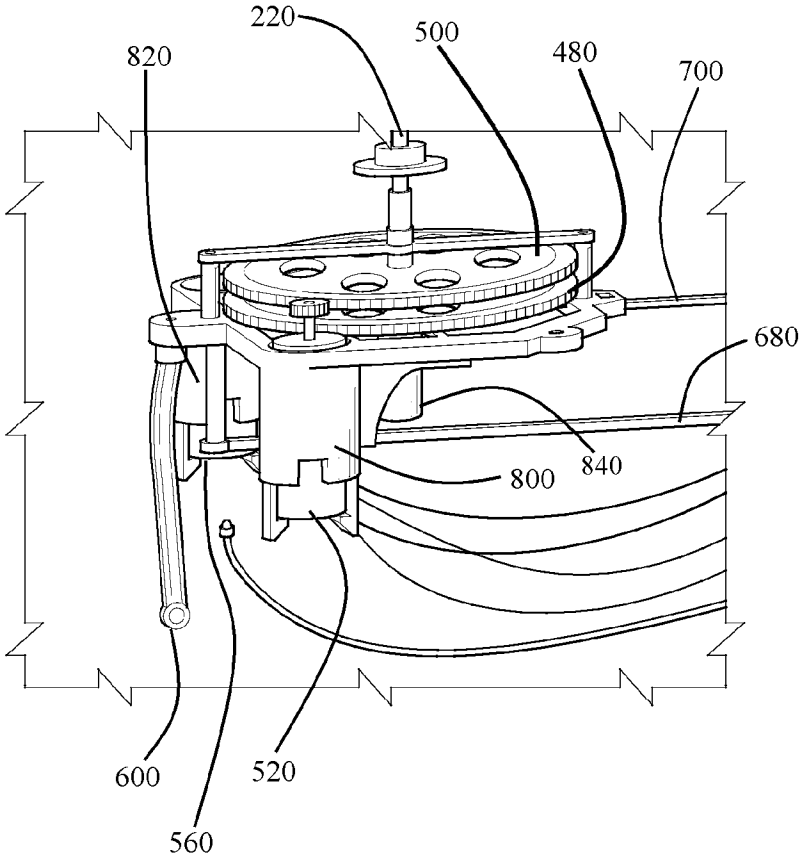
Figure 16:
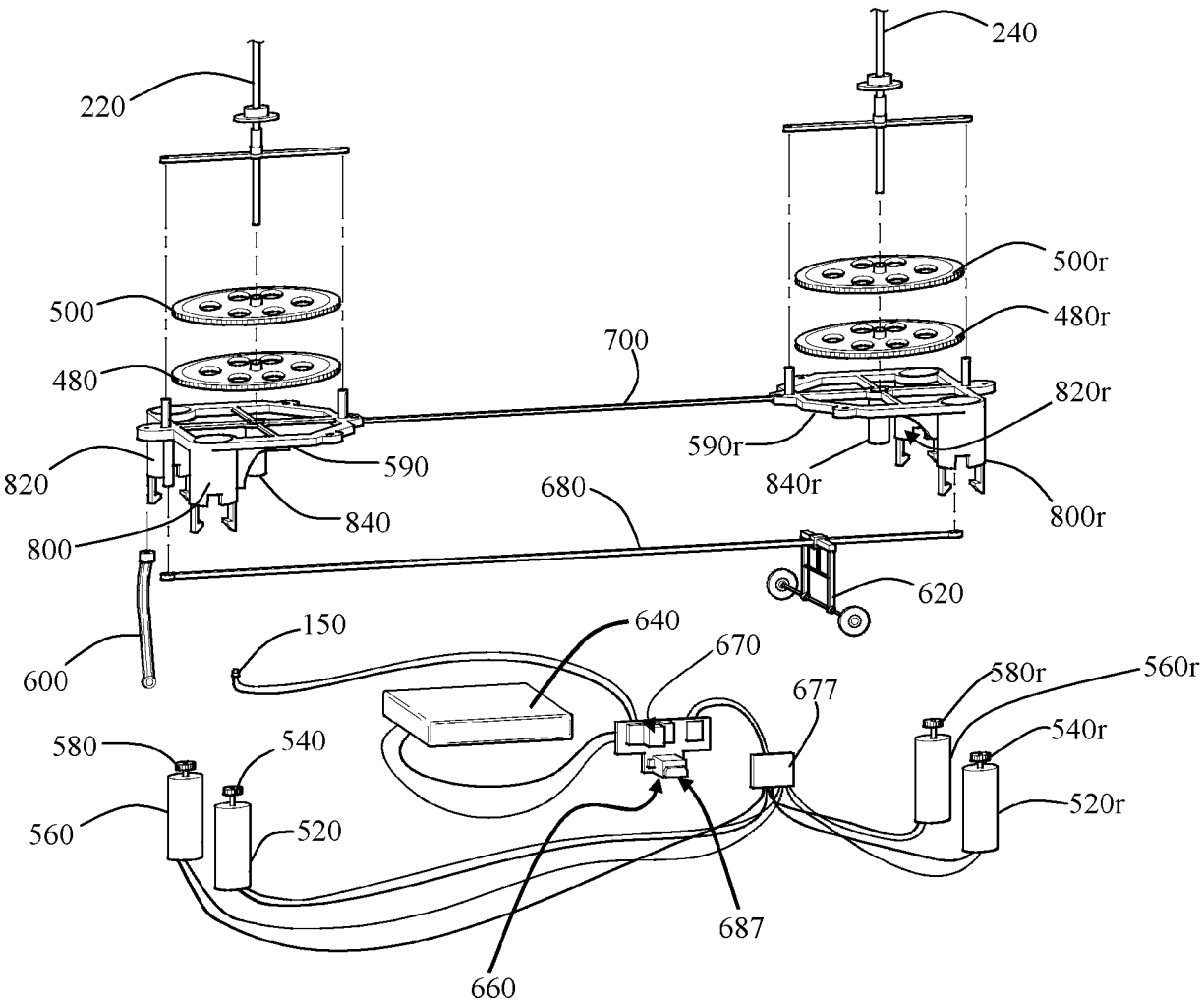
FIG. 16 is an exploded view of a model helicopter showing internal components with main body and rotor components not shown.
Figure 17:
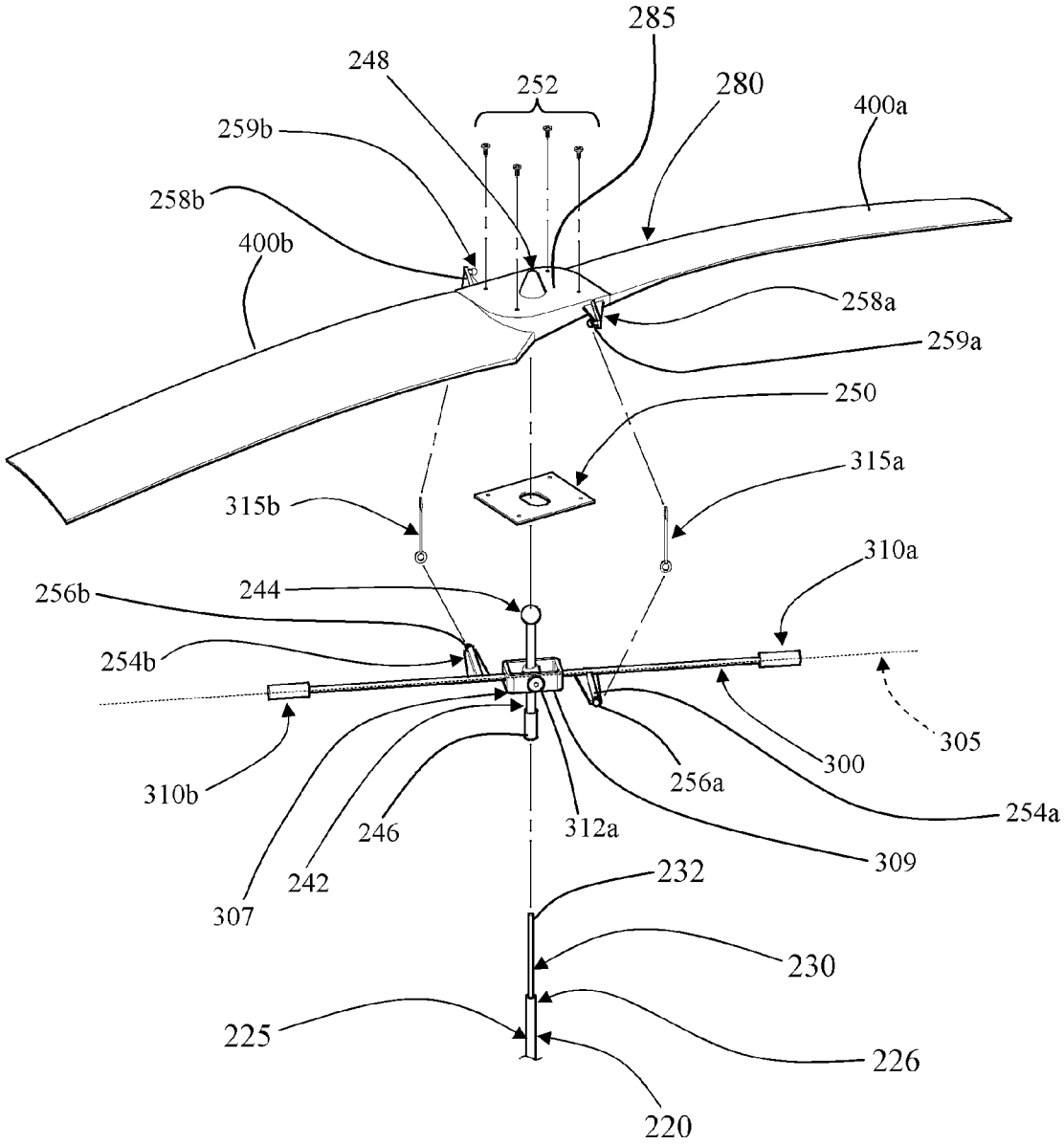
FIG. 17 is a partially exploded view of a front upper rotor and front stabilizing bar.
Figure 18:
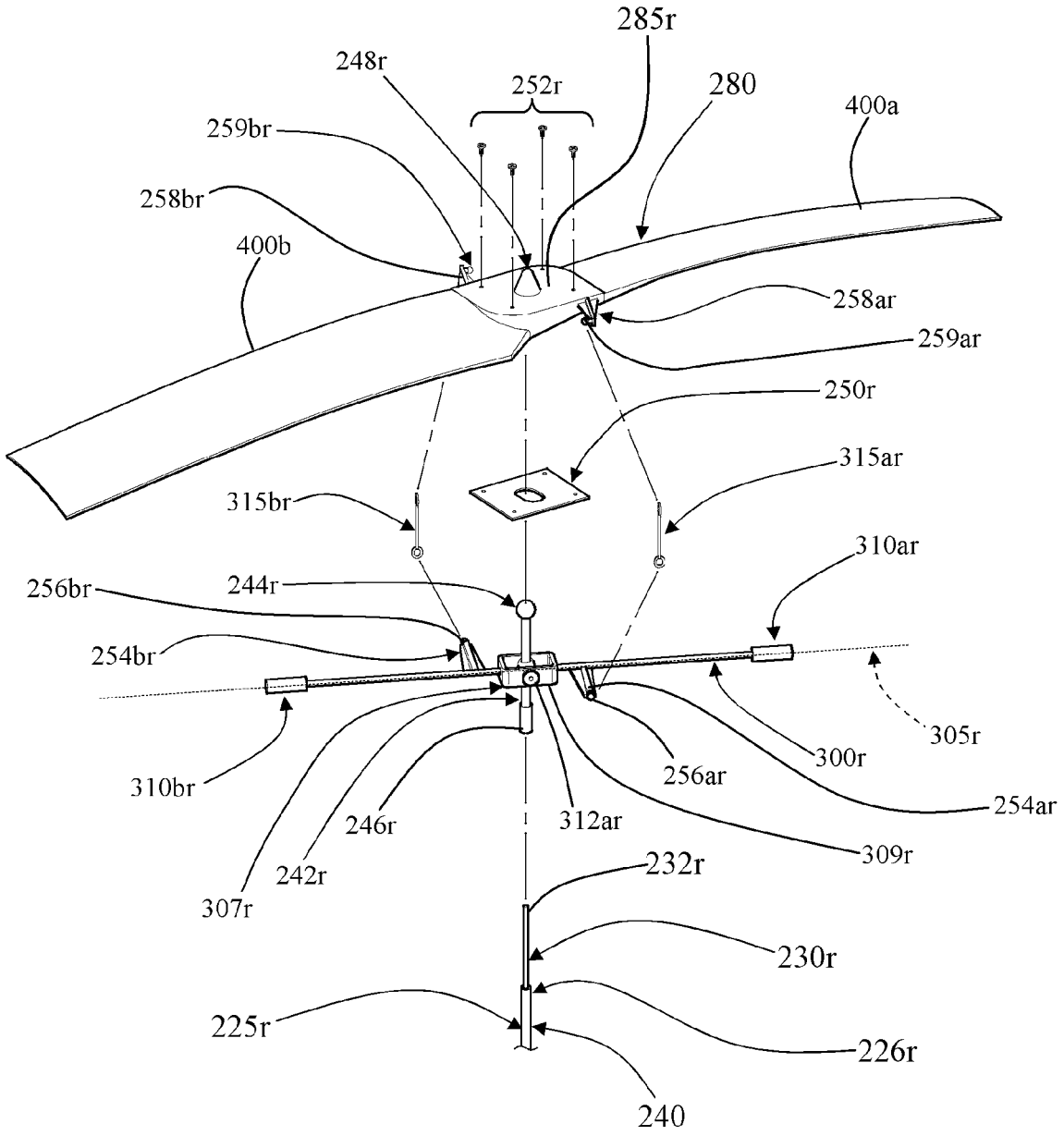
FIG. 18 is a partially exploded view of a rear upper rotor and a rear stabilizing bar.
Figure 19:
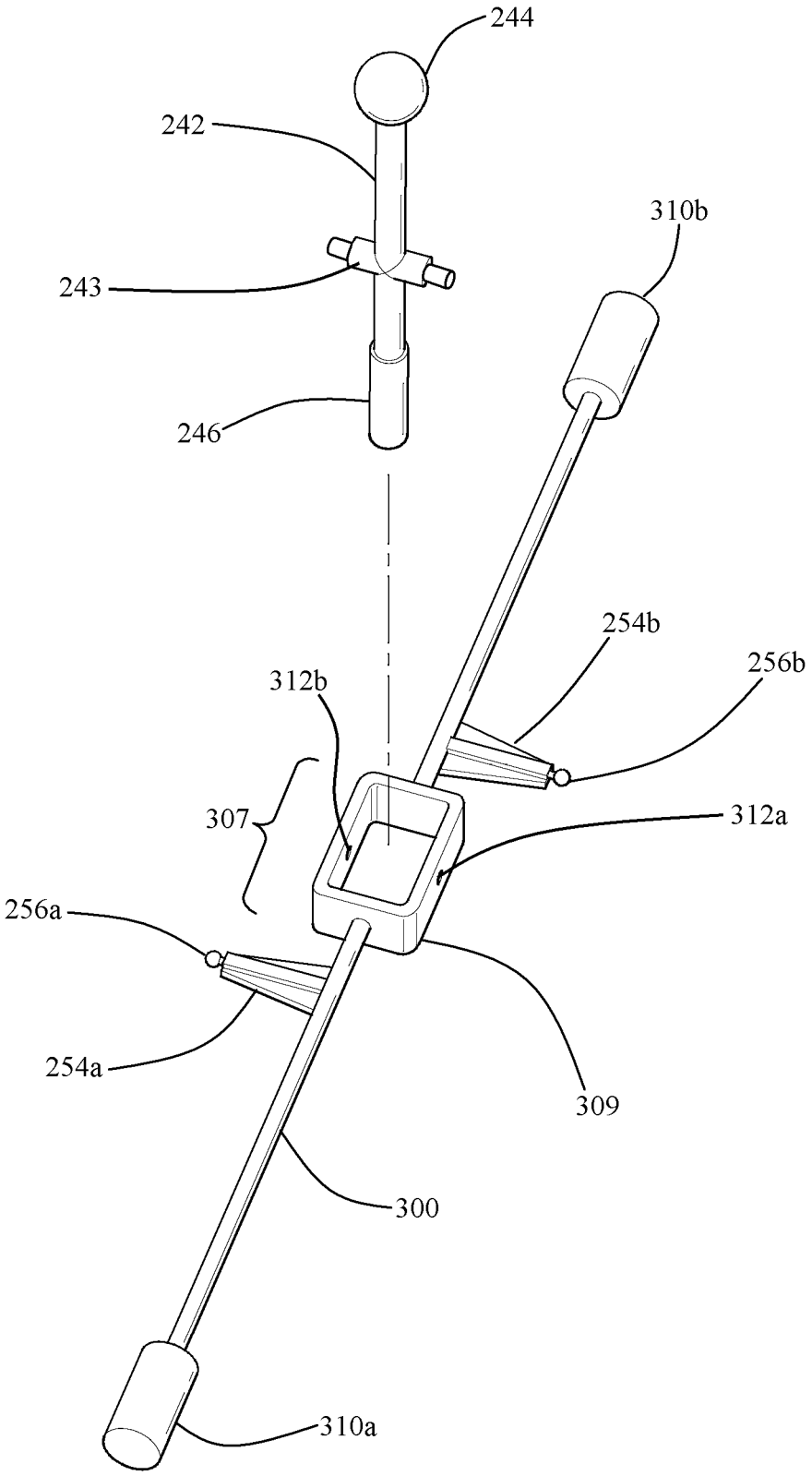
FIG. 19 shows a front stabilizing bar.
Figure 29:
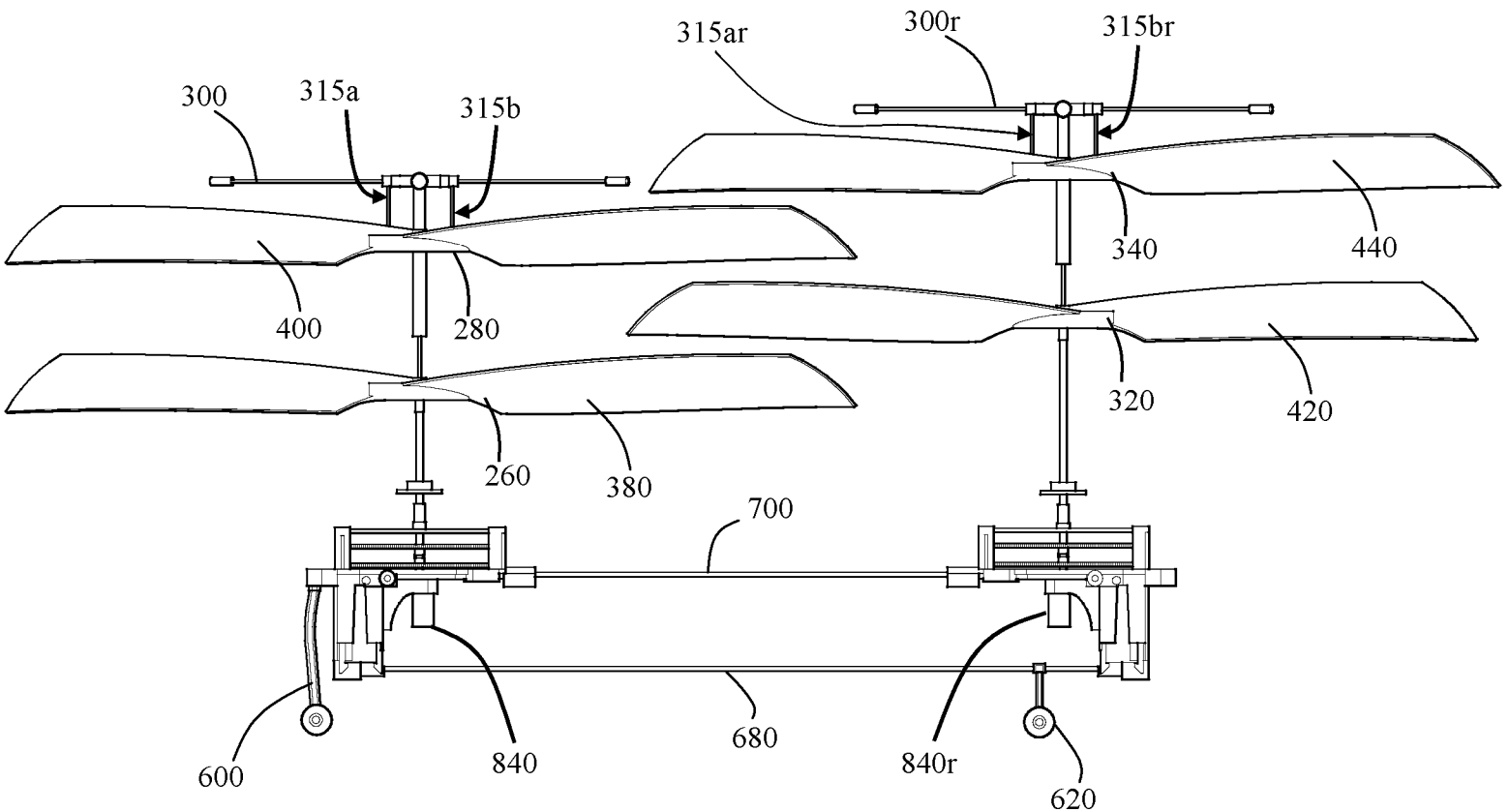
FIG. 29 shows an alternative rotor configuration.

The front upper rotor 280 is connected to the front stabilizing bar 300 by a front pair of first and second links 315*a* and 315*b* (see, e.g., FIG. 8), such that the up/down swinging motion of the front stabilizing bar 300 controls the pitch of the propeller blades 400 (represented in FIG. 1 by blades 400*a* and 400*b*) of the front upper rotor 280. While front stabilizing bar 300 is shown in FIG. 1 located beneath the front upper rotor 280 it will be understood by a person of ordinary skill in the art that the front stabilizing bar 300 could be mounted above the front upper rotor 280; an example of an alternative configuration is shown in FIG. 29.

The front lower and upper rotors 260 and 280 each comprises of at least two rotor blades. By way of exemplar the front lower rotor 260 is shown having two rotor blades 380 (represented in FIG. 1 with the alpha-numeric labels 380*a* and 380*b*; and front upper rotor 280 is shown having two rotor blades 400 (represented in FIG. 1 with the alpha-numeric labels 400*a* and 400*b*). The front lower and upper rotors 260 and 280 are rotated in opposite directions by front coaxial rotor shaft 220, i.e., lower and front upper rotors 260 and 280 are counter-rotated. It will be understood by persons of ordinary skill in the art that the number of blades that make up the front lower and upper rotors can vary in number.

The front coaxial rotor shaft 220 comprises an outer shaft 225 and an inner shaft 230. The outer shaft 225 defines a top end 226. The outer shaft 225 rotates the front lower rotor 260 while the inner shaft 230 rotates the front upper rotor 280 and front stabilizing bar 300. In an alternative embodiment the outer shaft 225 rotates the front upper rotor 280 and front stabilizing bar 300; and the inner shaft 230 rotates the front lower rotor 260. The inner shaft 230 defines a top end 232; more specifically, inner shaft 230 extends from the upper end of the outer shaft 225 revealing top end 232.

Front rotor shaft extension member 242 has a cross-shaped configuration having a cross-arm 243. The front rotor shaft extension member 242 extends from and fits over the inner shaft 230. More specifically, the rotor shaft extension member 242 has an upper ball shaped end 244, and a lower end 246; the lower end 246 is of generally cylindrical shape with a hollow bore of sufficient dimensions to fit over the top end 232 of inner shaft 230. The ball shaped end 244 fits into a concave socket 248 located on the underside of the middle portion 285 of the front upper rotor 280. More specifically, the concave socket 248 is located midway along the front upper rotor 280.

A fixing plate 250 secures the ball shaped end 244 to the interior of concave socket 248. A plurality of fasteners 252 are used to affix the fixing plate 250 to the underside of the middle portion 285 of the front upper rotor 280. In one non-limiting embodiment the rotor shaft extension member 242 also overlaps the outer shaft 225, but is not operatively connected to the outer shaft 225.

The front stabilizing bar 300 defines a first front longitudinal axis 305, and includes a middle portion 307 that defines an open rectangular section 309 with first and second opposite facing circular through bores 312*a* and 312*b*. First and second bores 312*a* and 312*b* are aligned at right angles with respect to axis 305 and since the first and second bores 312*a* and 312*b* form part of front stabilizing bar 300 the bores occupy the same plane of rotation as axis 305 and hence the same plane of rotation with respect to the front stabilizing bar 300.

The opposite ends of cross-arm 243 are respectively aligned with and at least partially fit inside bores 312*a* and 312*b*. The opposite ends of cross-arm 243 are free to rotate with respect to first and second bores 312*a* and 312*b* and thereby allow front stabilizing bar 300 to swing up and down in turn altering the pitch of blades 400 via linkages 315*a* and 315*b*.

The front stabilizing bar 300 defines first and second front stabilizing bar arms 254*a* and 254*b*. Arms 254*a* and 254*b* are located diagonally opposite each other with respect to section 309. The ends of arms 254*a* and 254*b* respectively define first and second front stabilizing joints 256*a* and 256*b*. The arms 254*a* and 254*b* occupy the same plane of rotation as axis 305 and hence the same plane of rotation with respect to the front stabilizing bar 300.

The front upper rotor 280 defines front upper rotor spurs 258*a* and 258*b*. The front upper rotor spurs 258*a* and 258*b* extend from the middle portion 285 of the front upper rotor 280. More specifically, spurs 258*a* and 258*b* are located diametrically opposite each other with respect to middle portion 285 of the front upper rotor 280. The ends of spurs 258*a* and 258*b* respectively define first and second front stabilizing spur joints 259*a* and 259*b*.

The front upper rotor 280 is mechanically coupled to front stabilizing bar 300 such that variations in the plane of rotation of the stabilizing bar 300 controls the pitch of the blades 400 of front upper rotor 280. More specifically, the lower and upper ends of link 315*a* are respectively affixed to joints 256*a* and 259*a*, and the lower and upper ends of link 315*b* are respectively affixed to joints 256*b* and 259*b*.

The front coaxial rotor shaft 220 is driven by a front drive gear assembly 460. The front drive gear assembly 460 includes first and second front gears 480 and 500, respectively. A front first electric motor 520 drives a front first pinion gear 540 which in turn drives the first front gear 480, while a second front electric motor 560 drives a second front pinion gear 580 that drives the second front gear 500.

In one non-limiting embodiment, the first and second gears 480 and 500 are respectively coupled to the inner and outer shafts 230 and 225 of front coaxial rotor shaft 220. In this embodiment, the first front motor 520 drives the front upper rotor 280 and front stabilizing bar 300 via first front gear 480; and the second front motor 560 drives the front lower rotor 260 via second front gear 500.

Alternatively, first and second front gears 480 and 500 are respectively coupled to the outer and inner shafts 225 and 230 of front coaxial rotor shaft 220. In this alternative embodiment, the first front motor 520 drives the front lower rotor 260 via first front gear 480; and the second front motor 560 drives the front upper rotor 280 and front stabilizing bar 300 via second front gear 500.

It will be understood by a person of ordinary skill in the art that the exact number and arrangement of front gears can vary.

The front first and second electric motors 520 and 560 are housed in a front subassembly 590. More specifically, the front subassembly 590 comprises first and second front motor housing units 800 and 820 in which are located first and second electric motors 520 and 560, respectively. The front subassembly 590 further comprises a front shaft-housing 840. One end of the front coaxial rotor shaft 220 is mounted inside front shaft-housing 840, and driven by a front drive gear assembly 460. The front drive gear assembly 460 comprises first and second front gears 480 and 500.

The rear coaxial rotor assembly 200 comprises a rear lower rotor 320, a rear upper rotor 340, and a rear stabilizing bar 300*r* operatively connected to the rear upper rotor 340. The rear stabilizing bar 300*r* has weighted opposite ends 310*ar* and 310*br*.

The rear stabilizing bar 300*r* stabilizes the rear upper rotor 340. During operation of the model helicopter 100 the rear lower rotor 320 and rear upper rotor 340 are rotated concentrically in opposite directions with respect to each other while the rear stabilizing bar 300*r* is concentrically rotated in the same direction as the rear upper rotor 340.

Rear lower and upper rotors 320 and 340 are counter rotated by rear coaxial rotor shaft 240. One end of rear coaxial rotor shaft 240 is mounted inside rear shaft-housing 840*r* and driven by a rear drive gear assembly 460*r*. The rear drive gear assembly 460*r* includes first and second rear gears 480*r* and 500*r*, respectively. A rear first electric motor 520*r* drives a rear first pinion gear 540*r* that drives the first rear gear 480*r*, while a rear second electric motor 560*r* drives a rear second pinion gear 580*r* that drives the second rear gear 500*r*.

The rear upper rotor 340 is connected to the rear stabilizing bar 300*r* by a rear pair of first and second links 315*ar* and 315*br*, such that the up/down swinging motion of the rear stabilizing bar 300*r* controls the pitch of the propeller blades 440 (represented in FIG. 1 by blades 440*a* and 440*b*) of the rear upper rotor 340. While rear stabilizing bar 300*r* is shown in FIG. 1 located beneath the rear upper rotor 340 it will be understood by a person of ordinary skill in the art that the rear stabilizing bar 300*r* could be mounted above the rear upper rotor 340.

The rear lower and upper rotors 320 and 340 each comprises of at least two rotor blades. By way of exemplar the rear lower rotor 320 is shown having two rotor blades 420 (represented in FIG. 1 with the alpha-numeric labels 420*a* and 420*b*; and rear upper rotor 340 is shown having two rotor blades 440 (represented in FIG. 1 with the alpha-numeric labels 440*a* and 440*b*). The rear lower and upper rotors 320 and 340 are rotated in opposite directions by rear coaxial rotor shaft 240, i.e., rear lower and upper rotors 320 and 340 are counter-rotated. It will be understood by persons of ordinary skill in the art that the number of blades that make up the rear lower and upper rotors can vary in number.

The rear coaxial rotor shaft 240 comprises an outer shaft 225*r* and an inner shaft 230*r*. The outer shaft 225*r* defines a top end 226*r*. The outer shaft 225*r* rotates the rear lower rotor 320 while the inner shaft 230*r* rotates the rear upper rotor 340 and rear stabilizing bar 300*r*. In an alternative embodiment the outer shaft 225*r* rotates the rear upper rotor 340 and rear stabilizing bar 300*r*; and the inner shaft 230*r* rotates the rear lower rotor 320. The inner shaft 230*r* defines a top end 232*r*; more specifically, inner shaft 230*r* extends from the upper end of the outer shaft 225*r* revealing top end 232*r*.

Rear rotor shaft extension member 242*r* has a cross-shaped configuration having a cross-arm 243*r*. The rear rotor shaft extension member 242*r* extends from and fits over the inner shaft 230*r*. More specifically, the rotor shaft extension member 242*r* has an upper ball shaped end 244*r*, and a lower end 246*r*; the lower end 246*r* is of generally cylindrical shape with a hollow bore of sufficient dimensions to fit over the top end 232*r* of inner shaft 230*r*. The ball shaped end 244*r* fits into a concave socket 248*r* located on the underside of the middle portion 285*r* of the rear upper rotor 340. More specifically, the concave socket 248*r* is located midway along the rear upper rotor 340.

A fixing plate 250*r* secures the ball shaped end 244*r* to the interior of concave socket 248*r*. A plurality of fasteners 252*r* is used to affix the fixing plate 250*r* to the underside of the middle portion 285*r* of the rear upper rotor 340. In one non-limiting embodiment the rotor shaft extension member 242*r* also overlaps the outer shaft 225*r*, but is not operatively connected to the outer shaft 225*r*.

The rear stabilizing bar 300*r* defines a first rear longitudinal axis 305*r*, and includes a middle portion 307*r* that defines an open rectangular section 309*r* with first and second opposite facing circular through bores 312*ar* and 312*br*. First and second bores 312*ar* and 312*br* are aligned at right angles with respect to axis 305*r* of the rear stabilizing bar 300*r* and since the first and second bores 312*ar* and 312*br* form part of rear stabilizing bar 300*r* the bores occupy the same plane of rotation as axis 305*r* and hence the same plane of rotation with respect to the rear stabilizing bar 300*r*.

The opposite ends of cross-arm 243*r* are respectively aligned with and at least partially fit inside bores 312*ar* and 312*br*. The opposite ends of cross-arm 243*r* are free to rotate with respect to first and second bores 312*ar* and 312*br* and thereby allow rear stabilizing bar 300*r* to swing up and down in turn altering the pitch of blades 440 via linkages 315*ar* and 315*br*.

The rear stabilizing bar 300*r* defines first and second rear stabilizing bar arms 254*ar* and 254*br*. Arms 254*ar* and 254*br* are located diagonally opposite each other with respect to section 309*r*. The ends of arms 254*ar* and 254*br* respectively define first and second rear stabilizing joints 256*ar* and 256*br*. The arms 254*ar* and 254*br* occupy the same plane of rotation as axis 305*r* and hence the same plane of rotation with respect to the rear stabilizing bar 300*r*.

The rear upper rotor 340 defines rear upper rotor spurs 258*ar* and 258*br*. The rear upper rotor spurs 258*ar* and 258*br* extend from the middle portion 285*r* of the rear upper rotor 340. More specifically, spurs 258*ar* and 258*br* are located diametrically opposite each other with respect to middle portion 285*r* of the rear upper rotor 340. The ends of spurs 258*ar* and 258*br* respectively define first and second rear stabilizing spur joints 259*ar* and 259*br*.

The rear upper rotor 340 is mechanically coupled to rear stabilizing bar 300*r* such that variations in the plane of rotation of the rear stabilizing bar 300*r* controls the pitch of the blades 440 of rear upper rotor 340. More specifically, the lower and upper ends of link 315*ar* are respectively affixed to joints 256*ar* and 259*ar*, and the lower and upper ends of link 315*br* are respectively affixed to joints 256*br* and 259*br*.

The rear coaxial rotor shaft 240 is driven by a rear drive gear assembly 460*r*. The rear drive gear assembly 460*r* includes first and second rear gears 480*r* and 500*r*, respectively. A rear first electric motor 520*r* drives a rear first pinion gear 540*r* which in turn drives the first rear gear 480*r*, while a second rear electric motor 560*r* drives a second rear pinion gear 580*r* that drives the second rear gear 500*r*.

In one non-limiting embodiment, the first and second gears 480*r* and 500*r* are respectively coupled to the inner and outer shafts 230*r* and 225*r* of rear coaxial rotor shaft 240. In this embodiment, the first rear motor 520*r* drives the rear upper rotor 340 and rear stabilizing bar 300*r* via first rear gear 480*r*; and the second rear motor 560*r* drives the rear lower rotor 320 via second rear gear 500*r*.

Alternatively, first and second rear gears 480*r* and 500*r* are respectively coupled to the outer and inner shafts 225*r* and 230*r* of rear coaxial rotor shaft 240. In this alternative embodiment, the first rear motor 520*r* drives the rear lower rotor 320 via first rear gear 480*r*; and the second rear motor 560*r* drives the rear upper rotor 340 and rear stabilizing bar 300*r* via second rear gear 500*r*.

It will be understood by a person of ordinary skill in the art that the exact number and arrangement of rear gears and can vary.

The rear first and second electric motors 520*r* and 560*r* are housed in a rear subassembly 590*r*. More specifically, the rear subassembly 590*r* comprises first and second rear motor housing units 800*r* and 820*r* in which are located first and second electric motors 520*r* and 560*r*, respectively. The rear subassembly 590*r* further comprises a rear shaft-housing 840*r*. The rear coaxial rotor shaft 240 is bearing mounted inside rear shaft-housing 840*r*, and driven by a rear drive gear assembly 460*r*. The rear drive gear assembly 460*r* comprises first and second rear gears 480*r* and 500*r*.

Upper and lower bars 680 and 700 connect the front and rear assemblies 590 and 590*r*. The lower and upper bars 680 and 700 can be made out of any suitable material providing the material is strong enough to withstand the stresses twisting torque generated along the length of the model helicopter 100 during flight while adding minimum additional weight to the model helicopter 100 which could deleteriously impact flight performance. The inventor discovered that using bars 680 and 700 made of carbon fiber provided the best solution. The lower and upper bars 680 and 700 are preferably aligned in the same vertical plane. The lower and upper bars 680 and 700 may be solid or take the form of a hollow tube with circular, regular polygonal (e.g., square or rectangular), or irregular polygonal cross-section shape.

The four motors 520, 560, 520*r* and 560*r* are powered by at least one battery 640. The at least one battery preferably comprises at least one rechargeable battery such as, but not limited to, a lithium polymer battery. The at least one battery 640 is preferably a single rechargeable battery connected to a recharge socket 660. The recharge socket 660 can be in communication with bottom side 130 of main body 120. It will be understood that the recharging socket 660 can be located elsewhere such as either side 124 or 126 of main body 120 or at the front or rear ends 140 and 160.

An on/off switch 670 can also be located on any side of the main body 120. For example, the on/off switch 670 can be located proximate to the recharge socket 660 on bottom side 130. The on/off switch 670 can be integrated with a circuit board 675. The circuit board 675 can take the form of a printed circuit board (PCB) and can comprise control circuitry for functioning as an onboard controller 679.

The onboard controller 679 controls the amount of power delivered to the front and rear pairs of motors in response to wireless control signals transmitted from a remote wireless controller 685 and received via receiver 687. In one non-limiting embodiment, the onboard controller 679 includes a processor and memory. The onboard controller 679 drives the four electric motors 520, 560, 520*r* and 560*r* in response to control signals received via receiver 687 from remote controller 685. In one embodiment, the onboard control comprises a printed circuit board (PCB) located inside the model helicopter, and divides the electrical current between the four motors to which it controls. The onboard controller can divide the electrical current equally or disproportionally between any or all of the four motors, in order to control the direction of flight (or the altitude) of the model helicopter as described below.

The direction of flight for the model helicopter 100 is controlled by the onboard controller 679. To turn the model helicopter 100 right or left or to make it go forward or backwards, or any combination of these directions, the onboard controller 679, in response to user input from a remote wireless controller 685, adjusts the amount of power delivered to each of the four electric motors 520, 560, 520*r* and 560*r*. For example, in one embodiment, in order to go forward, the onboard controller 679 increases the power (or current) to the two rear electric motors, 520*r* and 560*r*. This causes the rear of the model helicopter 100 to lift higher than the front of the model helicopter 100. This forward-tilt of the model helicopter 100 will result in the helicopter moving forward. In another embodiment, the onboard controller 679 decreases the power to the two front electric motors 520 and 560, thereby causing the front of the model helicopter 100 to dip lower than the rear of the model helicopter 100. This forward tilt of the model helicopter will also result in the helicopter moving forward. Likewise, to direct the helicopter backwards, the onboard controller 679 can decrease the power to the two rear electric motors 520*r* and 560*r*, or the onboard controller 679 can increase the power to the two front electric motors 520 and 560. The magnitude of the forward or backwards movement can be controlled by the onboard controller, varying the magnitude of the power increase (or decrease) to the two rear or two front motors as described above. In one embodiment, in order to turn right or left, the two onboard controller alters the speed of the rear motors (while maintaining the speed of the two front motors), either by decreasing the speed of one, increasing the speed of the other, or doing both operations. This way, the difference in the speed of the two rear motors will cause the coupled rotors to turn at different speeds, the resulting torque turns the model helicopter either right or left. This is in contrast to straight flight, where the speed of the two rear motors are the same, such that the torque of the counter-rotating rotors cancels each other out, resulting in straight flight. In another embodiment, the onboard controller alters the speed of the front motors to turn left or right, while maintaining the speed of the two rear motors. In another embodiment, the onboard controller alters the speed of all four motors, such that the resulting torque from the two sets of rotors turns the model helicopter either right or left. For example, in order to turn left (depending on the orientation and rotation of the rotor blades), the onboard controller causes the two top rotors 440 and 400 to rotate faster than the two bottom rotors 380 and 420. The speed of the two top rotors increase in proportion to each other, while the speed of the two bottom rotors remain constant and in proportion to each other. The opposite can be performed to turn the model helicopter right, that is, increasing the speed of the bottom two rotors while maintaining the speed of the top two rotors. As described above, a similar result (i.e., turning left) can be achieved by decreasing the speed of the bottom two rotor while maintaining the speed of the top two rotors. Also, a similar result can be achieved by both increasing the speed of the top two rotors and simultaneously decreasing the speed of the bottom two rotors. The magnitude (rate of change) of the turn left or right can be controlled by the onboard controller, varying the magnitude of the power increase (or decrease) to the four motors as described above. In another embodiment, a small amount of weight can be added to the front of the main body, thereby causing the model helicopter to have a constant forward motion. This small amount of weight can be used in combination with the flight control techniques using the onboard controller as described above, where the onboard controller will additionally compensate for this small forward movement—for example, by increasing the speed of the front two motors more to move backwards, in order to compensate for the constant forward movement.

This method allows one to control flight in the coplanar direction (i.e., turn right, turn left, move forward, move backwards) and is advantageous over the prior art because the prior art used additional motors or servos to modify the tilt of the rotors (without also tilting the main body of the helicopter) in order to direct the flight of the model helicopter. For example, in the prior art, in order to turn the model helicopter right, an additional motor would be activated to tilt (or angle) one or more of the rotors to the right, thereby causing thrust in the left direction, causing the model helicopter to turn right or otherwise travel in a generally right direction. The onboard controller can combine any of the individual coplanar movements described above to result in combination coplanar movements, such as left and forwards or right and backwards. Based on the disclosure above, the direction of flight can also be performed using only 2 or 3 motors, coupled to only two or three rotor assemblies respectively. Likewise, the direction of flight can also be performed using more than four motors coupled to rotor assemblies. In one embodiment, this method of directing flight can be achieved without altering the altitude of the model helicopter by controlling the four motors such that the total sum of vertical thrust remains constant despite the resulting speed variation between the various rotors. For example, to move forward in one embodiment, the onboard controller increases the power to the two rear electric motors. In order to maintain a constant altitude, the onboard controller will also decrease the power to the two front electric motors, thereby causing the total thrust to remain the same, allowing the model helicopter to maintain the same altitude. Similarly, in another embodiment to maintain constant altitude while turning right or left, the onboard controller will decrease the power to one or more of the motors, but will increase the power to one or more of the remaining motors. This results in a torque due to the difference in speed between either one set or both sets of rotors and will turn the model helicopter either right or left, but the total thrust will be the same, thereby maintaining the altitude of the model helicopter during the turn right or left.

In one embodiment, direction of flight in the coplanar direction is controlled using a two channel wireless controller. One channel controls the altitude and forward and backwards movement of the model helicopter, while the other channel turns the helicopter right or left. As discussed, the prior art used additional servos or motors to tilt one or more of the rotors in the direction of desired flight. Typically, this additional servo or motor requires the use of at least one additional channel. In one embodiment, the wireless controller and/or the onboard controller are configured such that large control differences (e.g., large movements of the joystick) on the altitude/forward/backward channel results in solely a change in altitude of the model helicopter, while small control differences (e.g., small movements of the joystick) on the same channel results in solely a movement forwards or backwards of the model helicopter. In another embodiment, control differences (e.g., joystick movements) near an equilibrium zone (i.e., the zone where the model helicopter generally maintains constant altitude) on the altitude/forward/backward channel of the wireless controller results in the model helicopter moving forwards or backwards, without changing altitude. In order to change altitude, the control differences must be outside the equilibrium zone (e.g., the joystick must be moved outside the equilibrium zone). In another embodiment the wireless controller and onboard controller are configured such that the model helicopter moves forward when altitude in increased and backwards when altitude is decreased, and will remain stationary when the altitude remains constant. In another embodiment, the wireless controller and onboard controller are configured such that the model helicopter initially moves forward when altitude is increased and backwards when altitude is decreased, but after a short time, will compensate by powering the motors in a manner that either reduces the forward/backwards movement or causes the model helicopter to remain stationary, while the model helicopter is still changing altitude. In another embodiment, the onboard controller powers the two rear motors of the model helicopter to move at a speed that is fixed to be faster than the speed of the two front motors. This speed differential can be between 5% to 50%. That is, the two rear motors throughout the entire range of speeds from stationary to full speed, operate at a constant faster speed (a fixed percentage between 5% to 50%) than the front two motors—the four motors and the coupled rotor blades are proportionally locked. In another embodiment, the speed differential can be between 10% to 25%. In another embodiment, the speed differential is 15%. As a result, the model helicopter will move forward constantly throughout the entire range of speeds, corresponding to the entire range of control on one channel of the wireless controller.

Lights are optionally placed throughout the helicopter and can be light bulbs, light emitting diodes (LED), or other light sources. The lights can be constantly on or programmed to flash according to a pattern. Moreover, the lights can be constructed and programmed to change the color of the emitted light. In another embodiment, the lights are controlled by the onboard controller 679, where their intensity, color and flash pattern are controlled depending on the user input from a remote wireless controller. In another embodiment, the lights are controlled by the onboard controller 679, where their intensity, color and flash pattern correspond to the speed of any or all of the four electric motors. In another embodiment, the lights are controlled by the onboard controller 679, where their intensity, color and flash pattern correspond to the direction of flight of the model helicopter. In one embodiment, the lights are arranged in between the plastic shell and the foamed plastic inner portion. The lights can be placed behind an opaque portion of the plastic shell, so that their light can be seen to glow through the thin plastic shell. The lights can also be placed behind a transparent section of the plastic shell, so that the light can be directly visible to the user. The lights can also be placed at the location of a cutout in the plastic shell, so that the light can be directly visible to the user. In one embodiment, the lights are arranged on a printed circuit board (PCB) that is configured as a thin strip, and is attached to the outer surface of the foamed plastic inner portion. The plastic shell is then placed over the foamed plastic inner portion, also covering the PCB light strip.

The remote controller 685 and the onboard receiver 687 can respectively transmit and receive any suitable wireless control signal to control the model helicopter 100. In one non-limiting embodiment the wireless control signal is selected from the group consisting of: radio frequency (RF) signals, infrared signals, and ultrasound signals, alone or in combination.

The model helicopter 100 is optionally fitted with landing gear. The landing gear can comprise, for example, a front landing support 600 and a pair of rear wheels 620.

Blades 400*a* and 400*b* collectively define a second front longitudinal axis 415. More specifically, blades 400*a* and 400*b* respectively define opposite ends 410*a* and 410*b* of front upper rotor 280. The longitudinal axis 415 passes through the opposite ends 410*a* and 410*b* of the front upper rotor 280 and through the vertical longitudinal axis of the front coaxial rotor shaft 220. The front stabilizing bar 300 has a longitudinal axis 305 that passes through the opposite ends 310*a* and 310*b* of the front stabilizing bar 300. The longitudinal axes 305 and 415 intersect the vertical longitudinal axis 221 of the front coaxial rotor shaft 220. The longitudinal axes 305 and 415 define a first acute angle alpha ($\alpha$) as viewed from above where the first acute angle alpha is represented by the Greek letter $\alpha$. The first acute angle alpha is between 30 degrees and 80 degrees. In one non-limiting embodiment the first acute angle alpha is between 30 degrees and 50 degrees. In another embodiment the first acute angle alpha is between 30 degrees and 45 degrees. In one non-limiting embodiment the first acute angle alpha is between 38 degrees and 42 degrees; in another embodiment the first acute angle alpha is 41 degrees.

Figure 20:
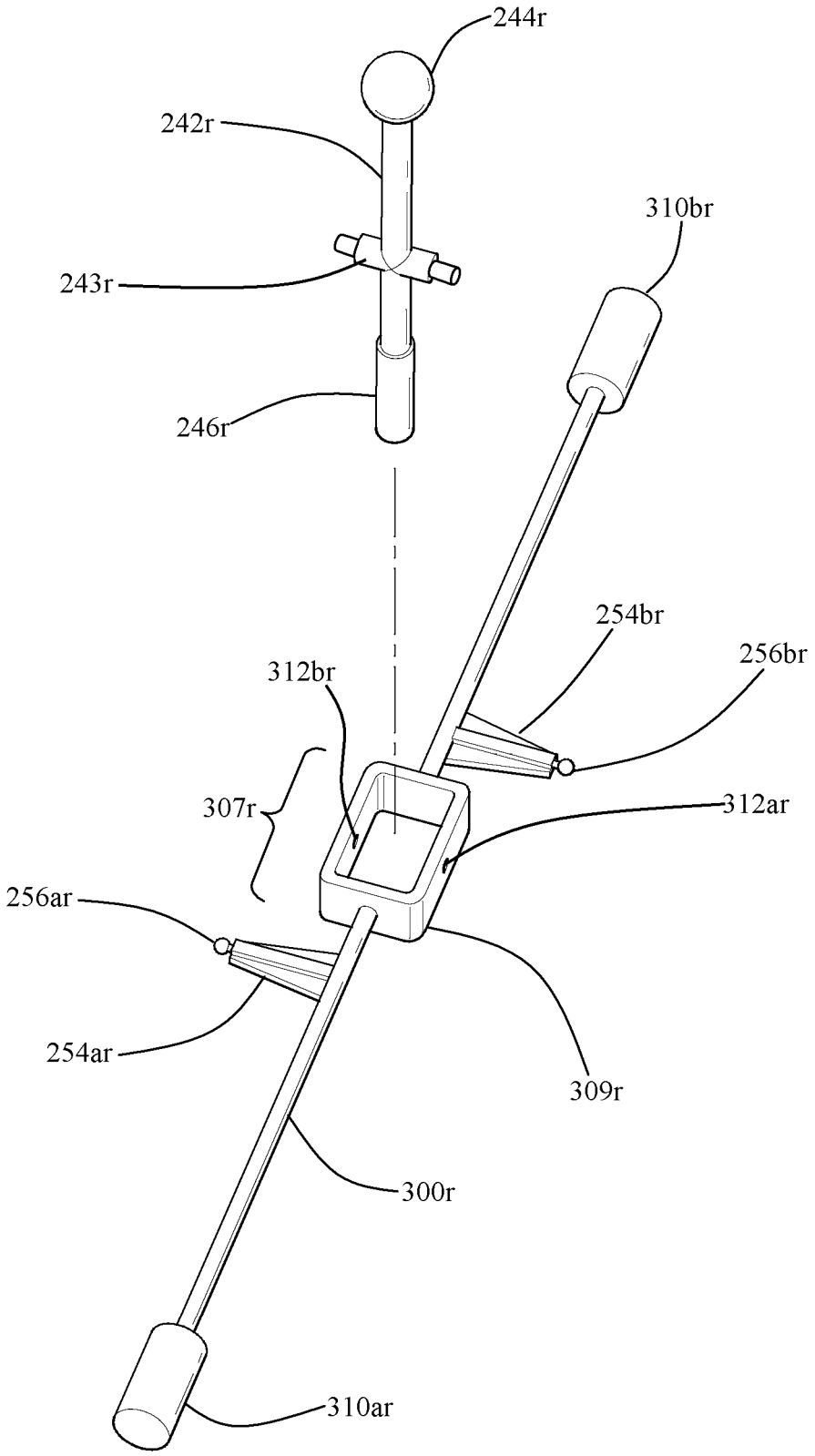
FIG. 20 shows a rear stabilizing bar.
Figure 21:
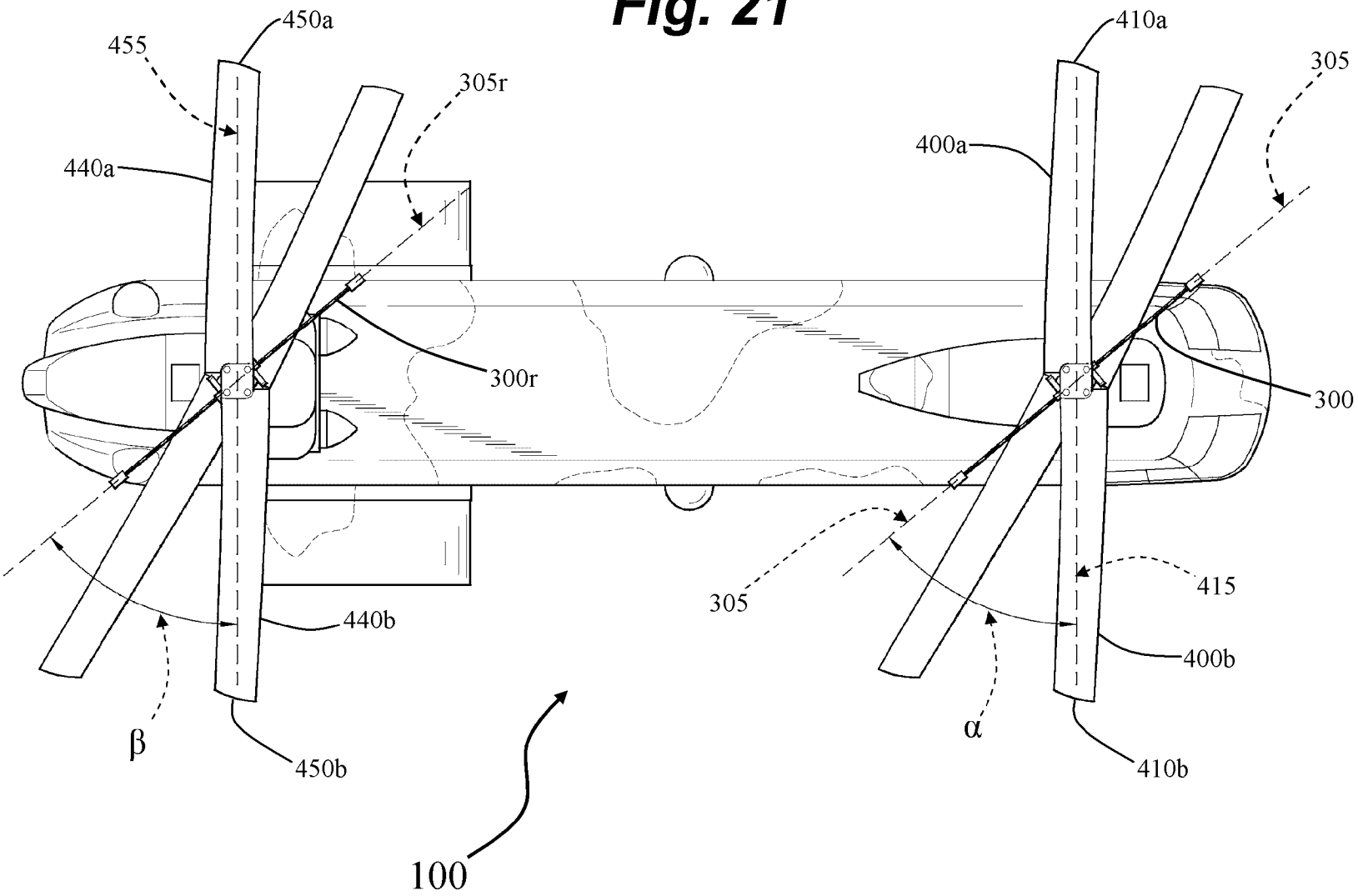
FIG. 21 shows a top view of a helicopter.
Figure 22:
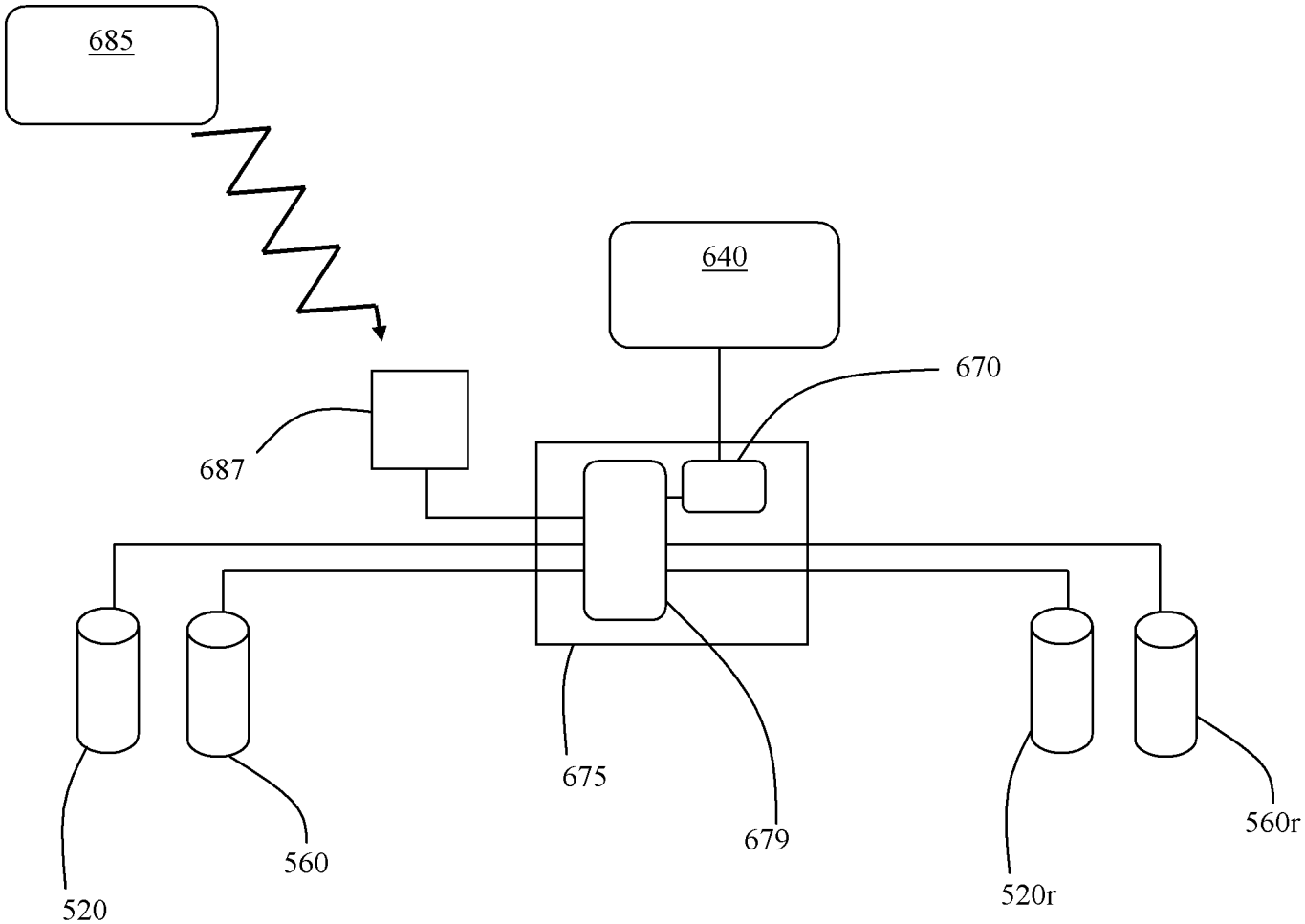
FIG. 22 shows a schematic of a helicopter.

Blades 440*a* and 440*b* collectively define a longitudinal axis 455. More specifically, blades 440*a* and 440*b* respectively define opposite ends 450*a* and 450*b* of rear upper rotor 340. The longitudinal axis 455 passes through the opposite ends 440*a* and 440*b* of the rear upper rotor 340 and through the vertical longitudinal axis 241 of the rear coaxial rotor shaft 240. The rear stabilizing bar 300*r* has a longitudinal axis 305*r* that passes through the opposite ends 310*ar* and 310*br* (shown in FIG. 20) of the front stabilizing bar 300*r*. The longitudinal axes 305*r* and 455 intersect the vertical longitudinal axis 241 of the rear coaxial rotor shaft 240. The longitudinal axes 305*r* and 455 define a second acute angle beta ($\beta$) as viewed from above where the second acute angle beta is represented by the Greek letter $\beta$.

The second acute angle beta is between 30 degrees and 80 degrees. In one non-limiting embodiment the second acute angle beta is between 30 degrees and 50 degrees. In another embodiment the second acute angle beta is between 30 degrees and 45 degrees. In one non-limiting embodiment the second acute angle beta is between 38 degrees and 42 degrees; in another embodiment the second acute angle beta is 41 degrees.

The numeric value of the first and second acute angles alpha and beta may be identical or vary between each other. However, the first and second acute angles alpha and beta preferably fall in the range between 30 degrees and 50 degrees, and more preferably fall between 35 degrees and 45 degrees.

The helicopter 100 is provided with a receiver 687, so that it can be controlled from a distance by means of a wireless control unit 685. For example, the wireless control unit 685 could be used to control the speed of the front and rear motors: 520 and 560, and 520*r* and 560*r*, respectively. It should be understood that any suitable form of wireless communication could be used to control the model helicopter 100. In one embodiment the wireless signal is selected from the group consisting of: radio frequency (RF) signals, infrared signals, and ultrasound signals, alone or in combination.

In summary, a front pair of battery-powered electric motors drives the front pair of counter-rotating main blades, while a rear pair of battery powered electric motors drives the rear pair of counter-rotating main blades. The transmission systems, battery, and circuitry are housed inside the main body of the model helicopter. A framework provides structural support between the front and rear end components, e.g., between the front and rear pairs of electric motors and gears.

The parts of the model helicopter can be made out of any suitable material. For example, the main body can be made out of any suitable material such as solid foam or Styrofoam. The blades can be made out of plastic. The parts of the transmission system can be made out of any suitable material; for example, the shafts and toothed gears can be made out of any suitable material such as metal (e.g., aluminum), carbon fiber or plastic.

The parts shown in FIGS. 1 through 22 and FIG. 29 are described above and in Table 1. Table 1 is found in FIG. 23, continuing through to FIG. 28.

The invention being thus described, it will be evident that the same may be varied in many ways by a routineer in the applicable arts. Such variations are not to be regarded as a departure from the spirit and scope of the invention and all such modifications are intended to be included within the scope of the claims.

What is claimed is:

1. A toy helicopter capable of flight and controller system, comprising:

a main body having front and rear ends;

at least one battery located in said main body;

a front coaxial rotor assembly, said front coaxial rotor assembly comprising:

a front lower rotor, said front lower rotor comprising at least two rotor blades;

a front upper rotor, said front upper rotor comprising at least two rotor blades; and a front stabilizing bar operatively connected to said front upper rotor;

a rear coaxial rotor assembly, said rear coaxial rotor assembly comprising:

a rear lower rotor, said rear lower rotor comprising at least two rotor blade;

a rear upper rotor, said rear lower rotor comprising at least two rotor blades; and rear stabilizing bar operatively connected to said rear upper rotor;

a motor for concentrically rotating said front lower and upper rotors in opposite directions such that said front lower rotor and said front upper rotor are counter-rotated with respect to each other;

a motor for concentrically rotating said rear lower and rear upper rotors in opposite directions such that said rear lower rotor and said rear upper rotor are counter-rotated with respect to each other;

a controller configured to transmit data to the toy helicopter;

a processor communicatively connected to the controller and toy helicopter;

the toy helicopter configured to receive data from the controller;

the controller comprising at least one channel;

a first channel having a range of positions, including an equilibrium zone of the first channel;

wherein the range of positions comprises a first position, a second position, a third position and a fourth position;

wherein the first position and second position are located within the equilibrium zone of the first channel;

wherein the third position and fourth position are located outside the equilibrium zone of the first channel;

wherein the processor is configured to increase the speed of both the rear lower rotor and rear upper rotor, while decreasing the speed of both the front lower rotor and front upper rotor such that a total sum of vertical thrust remains constant, to cause a forwards movement of the toy helicopter while maintaining substantially the same altitude, in response to the first channel being positioned to the first position;

wherein the processor is configured to decrease the speed of both the rear lower rotor and rear upper rotor, while increasing the speed of both the front lower rotor and front upper rotor such that a total sum of vertical thrust remains constant, to cause a backwards movement of the toy helicopter while maintaining substantially the same altitude, in response to the first channel being positioned to the second position;

wherein the processor is configured to increase the speed of the rear lower rotor, rear upper rotor, front lower rotor and front upper rotor, to cause an increase of altitude of the toy helicopter, in response to the first channel being positioned to the third position;

wherein the processor is configured to decrease the speed of the rear lower rotor, rear upper rotor, front lower rotor and front upper rotor, to cause a decrease of altitude of the toy helicopter, in response to the first channel being positioned to the fourth position; and a second channel having a range of positions;

wherein the range of positions comprises a fifth position and a sixth position;

wherein the processor is configured to vary the speed of two or more of the rear lower rotor, rear upper rotor, front lower rotor, and front upper rotor such that the resulting torque turns the toy helicopter left in response to the second channel being positioned in the fifth position;

wherein the processor is configured to vary the speed of two or more of the rear lower rotor, rear upper rotor, front lower rotor, and front upper rotor such that the resulting torque turns the toy helicopter right in response to the second channel being positioned in the sixth position;

wherein such a configuration allows the toy helicopter to turn right, turn left, move forward, and move backward without the use of an additional motor or servo for tilting one or more of the rotors or helicopter body in a direction of desired flight.

2. The toy helicopter model helicopter of claim 1, wherein said front upper rotor comprises two rotor blades, wherein said front stabilizing bar and said front upper rotor each define a longitudinal axis, wherein the axes of said front stabilizing bar and said front upper rotor define a first acute angle alpha, wherein the first acute angle alpha is between 30 degrees and 80 degrees.

3. The toy helicopter model helicopter of claim 1, wherein said front upper rotor comprises two rotor blades, wherein said front stabilizing bar and said front upper rotor each define a longitudinal axis, wherein the axes of said front stabilizing bar and said front upper rotor define a first acute angle alpha, wherein the first acute angle alpha is between 30 degrees and 50 degrees.

4. The toy helicopter model helicopter of claim 1, wherein said front upper rotor comprises two rotor blades, wherein said front stabilizing bar and said front upper rotor each define a longitudinal axis, wherein the axes of said front stabilizing bar and said front upper rotor define a first acute angle alpha, wherein the first acute angle alpha is between 30 degrees and 45 degrees.

5. The toy helicopter model helicopter of claim 1, wherein said front upper rotor comprises two rotor blades, wherein said front stabilizing bar and said front upper rotor each define a longitudinal axis, wherein the axes of said front stabilizing bar and said front upper rotor define a first acute angle alpha, wherein the first acute angle alpha is between 38 degrees and 42 degrees.

6. The toy helicopter model helicopter of claim 1, wherein said front upper rotor comprises two rotor blades, wherein said front stabilizing bar and said front upper rotor each define a longitudinal axis, wherein the axes of said front stabilizing bar and said front upper rotor define a first acute angle alpha, wherein the first acute angle alpha is 41 degrees.

7. The toy helicopter model helicopter of claim 1, wherein said rear upper rotor comprises two rotor blades, wherein said rear stabilizing bar and said rear upper rotor each define a longitudinal axis, wherein the axes of said rear stabilizing bar and said rear upper rotor define a second acute angle beta, wherein the second acute angle beta is between 30 degrees and 80 degrees.

8. The toy helicopter model helicopter of claim 1, wherein said rear upper rotor comprises two rotor blades; wherein said rear stabilizing bar and said rear upper rotor each define a longitudinal axis, wherein the axes of said rear stabilizing bar and said rear upper rotor define a second acute angle beta, wherein the second acute angle beta is between 30 degrees and 50 degrees.

9. The toy helicopter model helicopter of claim 1, wherein said rear upper rotor comprises two rotor blades, wherein said rear stabilizing bar and said rear upper rotor each define a longitudinal axis, wherein the axes of said rear stabilizing bar and said rear upper rotor define a second acute angle beta, wherein the second acute angle beta is between 30 degrees and 45 degrees.

10. The toy helicopter model helicopter of claim 1, wherein said rear upper rotor comprises two rotor blades, wherein said rear stabilizing bar and said rear upper rotor each define a longitudinal axis, wherein the axes of said rear stabilizing bar and said rear upper rotor define a second acute angle beta, wherein the second acute angle beta is between 38 degrees and 42 degrees.

11. The toy helicopter model helicopter of claim 1, wherein said rear upper rotor comprises two rotor blades, wherein said rear stabilizing bar and said rear upper rotor each define a longitudinal axis, wherein the axes of said rear stabilizing bar and said rear upper rotor define a second acute angle beta, wherein the second acute angle beta is 41 degrees.

12. The toy helicopter model helicopter of claim 1, wherein the main body comprises a plastic outer shell.

13. The toy helicopter model helicopter of claim 12, further comprising lights arranged beneath the plastic outer shell, such that the glow of the lights is visible to a user.

14. A toy helicopter capable of flight and controller system, comprising:

a main body having front and rear ends;

at least one battery located in said main body;

a front coaxial rotor assembly, said front coaxial rotor assembly comprising:

a front lower rotor, said front lower rotor comprising at least two rotor blades;

a front upper rotor, said front upper rotor comprising at least two rotor blades; and a front stabilizing bar operatively connected to said front upper rotor;

a rear coaxial rotor assembly, said rear coaxial rotor assembly comprising:

a rear lower rotor, said rear lower rotor comprising at least two rotor blade;

a rear upper rotor, said rear lower rotor comprising at least two rotor blades; and rear stabilizing bar operatively connected to said rear upper rotor;

an onboard controller controlling four motors that are coupled to the front lower rotor, the front upper rotor, the rear lower rotor and the rear upper rotor;

the onboard controller varying the speed of each of the four motors to direct the flight of the toy helicopter;

a means for concentrically rotating said front lower and upper rotors in opposite directions such that said front lower rotor and said front upper rotor are counter-rotated with respect to each other; and a means for concentrically rotating said rear lower and rear upper rotors in opposite directions such that said rear lower rotor and said rear upper rotor are counter-rotated with respect to each other;

wherein said means for concentrically rotating said front lower and upper rotors in opposite directions comprises first and second front electric motors;

wherein said means for concentrically rotating said rear lower and upper rotors in opposite directions comprises first and second rear electric motors;

a controller configured to transmit data to the toy helicopter;

a processor communicatively connected to the controller and toy helicopter;

the toy helicopter configured to receive data from the controller;

the controller comprising at least one channel;

a first channel having a range of positions configured to control altitude and forward movement of the toy helicopter;

wherein the range of positions comprises a first position, a second position and a third position;

wherein the processor is configured to rotate the rear lower rotor, rear upper rotor, front lower rotor and front upper rotor rotate with sufficient speed to increase the altitude of the toy helicopter, in response to the first channel being positioned to the first position;

wherein the processor is configured to rotate the rear lower rotor, rear upper rotor, front lower rotor and front upper rotor rotate with sufficient speed to maintain the altitude of the toy helicopter, in response to the first channel being positioned to the second position;

wherein the processor is configured to rotate the rear lower rotor, rear upper rotor, front lower rotor and front upper rotor with sufficient speed to slowly decrease the altitude of the toy helicopter, in response to the first channel being positioned to the third position;

wherein for each of the first, second, and third positions, the processor is configured to operate the rear lower rotor and rear upper rotor at a faster differential speed in comparison to the front lower rotor and front upper rotor, such that the toy helicopter will move forward constantly throughout the entire range of positions of the first channel;

wherein the faster differential speed of the rear lower rotor and rear upper rotor is between 5% and 50% faster than the speed of the front lower rotor and front upper rotor.

15. The toy helicopter model helicopter of claim 14, wherein the main body comprises a plastic outer shell encasing an inner portion comprising a foam material; and, wherein the inner portion is secured to the plastic outer shell by encasement, without the use of fasteners or adhesives.

16. The toy helicopter model helicopter of claim 15, further comprising lights arranged beneath the plastic outer shell, such that a glow of the lights is visible to a user.

17. The toy helicopter model helicopter of claim 14, wherein the onboard controller is controlled by input from a two channel wireless controller.

18. A method for controlling flight, comprising:

varying the speed of each of four motors to direct the flight of a toy helicopter in coplanar directions;

wherein two of the four motors are coupled to concentrically rotate front lower and front upper rotors in opposite directions such that said front lower rotor and said front upper rotor are counter-rotated with respect to each other about a front rotor shaft, forming a first set of concentrically rotating rotors;

wherein the remaining two of the four motors are coupled to concentrically rotate rear lower and rear upper rotors in opposite directions such that said rear lower rotor and said rear upper rotor are counter-rotated with respect to each other about a rear rotor shaft, forming a second set of concentrically rotating rotors;

wherein to direct the flight of the toy helicopter to turn left or right, the first and second sets of concentrically rotating rotors are controlled such that the speed of the upper rotors differs from the speed of the lower rotors, the difference in speed causing a first torque about the front rotor shaft and a second torque about the rear rotor shaft;

wherein the first torque and second torque result in a total torque;

wherein the total torque turns the toy helicopter right or left;

wherein a first channel controls the altitude and forwards and backwards movement of the toy helicopter and a second channel controls turning the toy helicopter right or left.

19. The method of claim 18, further comprising directing the flight of the toy helicopter without using motors to tilt the rotors in the direction of desired flight.

20. The method of claim 18, wherein the coplanar directions are right, left, forwards and backwards, and any combination thereof.

21. The method of claim 18, wherein the variation of speed of each of the four motors to direct the flight of the toy helicopter does not change the altitude of the toy helicopter.

22. The method of claim 18, wherein the speed of each of the four motors is controlled by an onboard controller that is controlled by input from a two channel wireless controller.

23. The toy helicopter model helicopter of claim 1, wherein the processor is located within the toy helicopter.

* * * * *